US010916366B2

(12) United States Patent
Lee

(10) Patent No.: US 10,916,366 B2
(45) Date of Patent: Feb. 9, 2021

(54) INDUCTOR AND METHOD OF MANUFACTURING THE SAME

(71) Applicant: SAMSUNG ELECTRO-MECHANICS CO., LTD., Suwon-si (KR)

(72) Inventor: Yong Sam Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 192 days.

(21) Appl. No.: 15/875,298

(22) Filed: Jan. 19, 2018

(65) Prior Publication Data

US 2019/0035533 A1 Jan. 31, 2019

(30) Foreign Application Priority Data

Jul. 25, 2017 (KR) ..... 10-2017-0094147

(51) Int. Cl.

| | |
|---|---|
| ***H01F 27/28*** | (2006.01) |
| ***H01F 27/29*** | (2006.01) |
| ***H01F 27/32*** | (2006.01) |
| ***H01F 41/12*** | (2006.01) |
| ***H01F 41/04*** | (2006.01) |

(Continued)

(52) U.S. Cl.

CPC ..... *H01F 27/2804* (2013.01); *H01F 17/0013* (2013.01); *H01F 17/04* (2013.01); *H01F 27/29* (2013.01); *H01F 27/292* (2013.01); *H01F 27/323* (2013.01); *H01F 41/042* (2013.01); *H01F 41/046* (2013.01); *H01F 41/122* (2013.01); *H01F 1/34* (2013.01); *H01F 2017/048* (2013.01); *H01F 2027/2809* (2013.01)

(58) Field of Classification Search

CPC .... H01F 27/2804; H01F 27/29; H01F 27/323; H01F 2027/2809; H01F 17/0013; H01F 2017/048; H01F 27/292

USPC ..... 336/200, 232

See application file for complete search history.

(56) References Cited

U.S. PATENT DOCUMENTS 6,600,404 B1 * 7/2003 Kajino ..... H01F 5/003 257/531

2004/0164835 A1 8/2004 Shoji (Continued)

FOREIGN PATENT DOCUMENTS

JP 11-204337 7/1999

JP 2004-253684 A 9/2004

(Continued)

OTHER PUBLICATIONS

Japanese Office Action dated Sep. 11, 2018 issued in Japanese Patent Application No. 2018-004791 (with English translation).

(Continued)

*Primary Examiner* — Tszfung J Chan

(74) *Attorney, Agent, or Firm* — Morgan, Lewis & Bockius LLP

(57) ABSTRACT

An inductor includes a body including an insulating portion formed of a plurality of layers and a magnetic portion surrounding the insulating portion and external electrodes disposed on external surfaces of the body, and a method of manufacturing the same. A coil portion is embedded in the insulating portion, and has a structure in which coil patterns formed on a plurality of layers are stacked while being connected to each other.

12 Claims, 22 Drawing Sheets

I - I'

(51) Int. Cl.

| | |
|---|---|
| ***H01F 17/04*** | (2006.01) |
| ***H01F 17/00*** | (2006.01) |
| *H01F 1/34* | (2006.01) |

(56) References Cited

U.S. PATENT DOCUMENTS

| | | | | |
|---|---|---|---|---|
| 2005/0184848 | A1* | 8/2005 | Yoshida | H01F 17/0013 336/223 |
| 2008/0180206 | A1* | 7/2008 | Fouquet | H01F 19/08 336/200 |
| 2010/0126765 | A1 | 5/2010 | Kim et al. | |
| 2013/0200977 | A1* | 8/2013 | Miyazaki | H01L 24/24 336/192 |
| 2014/0306792 | A1* | 10/2014 | Yoneda | H01F 27/2804 336/200 |
| 2014/0353022 | A1* | 12/2014 | Morita | H05K 1/0225 174/260 |
| 2015/0035634 | A1* | 2/2015 | Nakamura | H01F 41/046 336/170 |
| 2015/0048918 | A1 | 2/2015 | Park et al. | |
| 2016/0163444 | A1* | 6/2016 | Choi | H01F 17/0013 336/200 |
| 2016/0276094 | A1 | 9/2016 | Lee et al. | |
| 2019/0057803 | A1* | 2/2019 | Muraoka | H01F 27/2804 |

FOREIGN PATENT DOCUMENTS

| | | | |
|---|---|---|---|
| JP | 2010-130003 | A | 6/2010 |
| JP | 2014-232837 | A | 12/2014 |
| JP | 2014229739 | A * | 12/2014 |
| KR | 10-2001-0001338 | | 1/2001 |
| KR | 10-2015-0019588 | | 2/2015 |
| KR | 10-2016-0111153 | A | 9/2016 |
| KR | 10-2017-0060296 | A | 6/2017 |

OTHER PUBLICATIONS

Korean Office Action dated Aug. 13, 2018 issued in Korean Patent Application No. 10-2017-0094147 (with English translation).

* cited by examiner

I - I'

INDUCTOR AND METHOD OF MANUFACTURING THE SAME

CROSS-REFERENCE TO RELATED APPLICATION

This application claims the benefit of priority to Korean Patent Application No. 10-2017-0094147 filed on Jul. 25, 2017 in the Korean Intellectual Property Office, the disclosure of which is incorporated herein by reference in its entirety.

BACKGROUND

1. Field

The present disclosure relates to an inductor and a method of manufacturing the same, and more particularly, to a large inductance power inductor appropriate for a low profile, and a method of manufacturing the same.

2. Description of Related Art

Recently, a thickness of a coil of a thin film power inductor having a low-profile needs to be reduced in order to lower a thickness of a device in which a power inductor is mounted. However, in a structure of an existing power inductor, there is a technical limitation depending on a reduction in the thickness and a cross-sectional area of the coil corresponding to the low-profile. In addition, in a structure of a thin film inductor, there is a limitation in a thickness of a substrate at which equipment may be driven in a method of manufacturing the coil by plating of patterns, and to this end, the patterns need to be formed symmetrically to each other in relation to a predetermined core. However, due to the use of the core of the coils of reduced thickness, a space in the core in which a magnetic material may be filled is reduced, and there may be a limitation in a design of the coil for the purpose of the low-profile.

SUMMARY

An aspect of the present disclosure may provide an inductor capable of having a low-profile and being driven in a line equipment according to the related art.

According to an aspect of the present disclosure, an inductor may include a first insulating portion and a second insulating portion in contact with, respectively, an upper surface and a lower surface of a first insulating film positioned at a center of a chip, and second and third insulating films covering the first and second insulating portions, respectively. An upper coil and a lower coil may be included in the first and second insulating portions, respectively. First and second external electrodes connected to the upper and lower coils may be disposed on external surfaces of a body including the upper and lower coils. The upper coil may include first via pads and first plating layers formed on the first via pads, and the lower coil may include second via pads and second plating layers formed on the second via pads. Here, both end portions of each of the first and second via pads may include protrusion portions protruding with respect to lower surfaces of the first and second plating layers, and the upper surface and the lower surface of the first insulating film may be boundary surfaces distinguished from the first and second insulating portions, respectively.

According to another aspect of the present disclosure, a method of manufacturing an inductor may include: preparing a substrate having insulating properties; laminating first insulating films on upper and lower surfaces of the substrate; forming first metal thin film layers on upper and lower surfaces of the first insulating films, respectively; disposing patterned insulating patterns on and below the first metal thin film layers; forming first metal pattern layers in openings of the patterned insulating patterns; removing the patterned insulating patterns and the first metal thin film layers disposed below the patterned insulating patterns; laminating first insulating portions on upper and lower surfaces of first plating layers; patterning the first insulating portions using a laser beam to form openings penetrating through the first insulating portions; forming the first plating layers in the openings of the first insulating portions; laminating second insulating films on the upper and lower surfaces of the first plating layers; drilling via holes penetrating through the second insulating film to expose at least portions of the first plating layers; forming second metal thin film layers on surfaces of the second insulating films and the via holes; disposing patterned insulating patterns on the second metal thin film layers; forming second metal pattern layers in openings of the patterned insulating patterns and the via holes; removing the patterned insulating patterns and the second metal thin film layers disposed below the patterned insulating patterns; laminating second insulating portions on upper and lower surfaces of second plating layers; patterning the second insulating portions using a laser beam to form openings penetrating through the second insulating portions; forming the second plating layers in the openings of the second insulating portions; forming third insulating films on and below the second plating layers; providing a plurality of bodies by separately separating the substrate; and forming external electrodes on external surfaces of the bodies.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, an inductor and a method of manufacturing the same according to an exemplary embodiment in the present disclosure will be described. However, the present disclosure is not necessarily limited thereto.

Inductor

Figure 1:
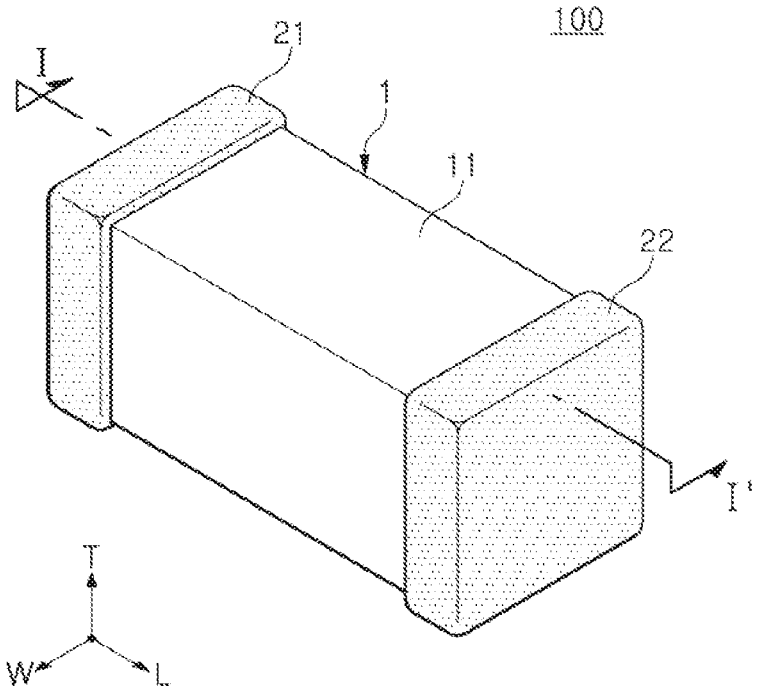
FIG. 1 is a schematic perspective view illustrating an inductor according to an exemplary embodiment in the present disclosure.
Figure 2:
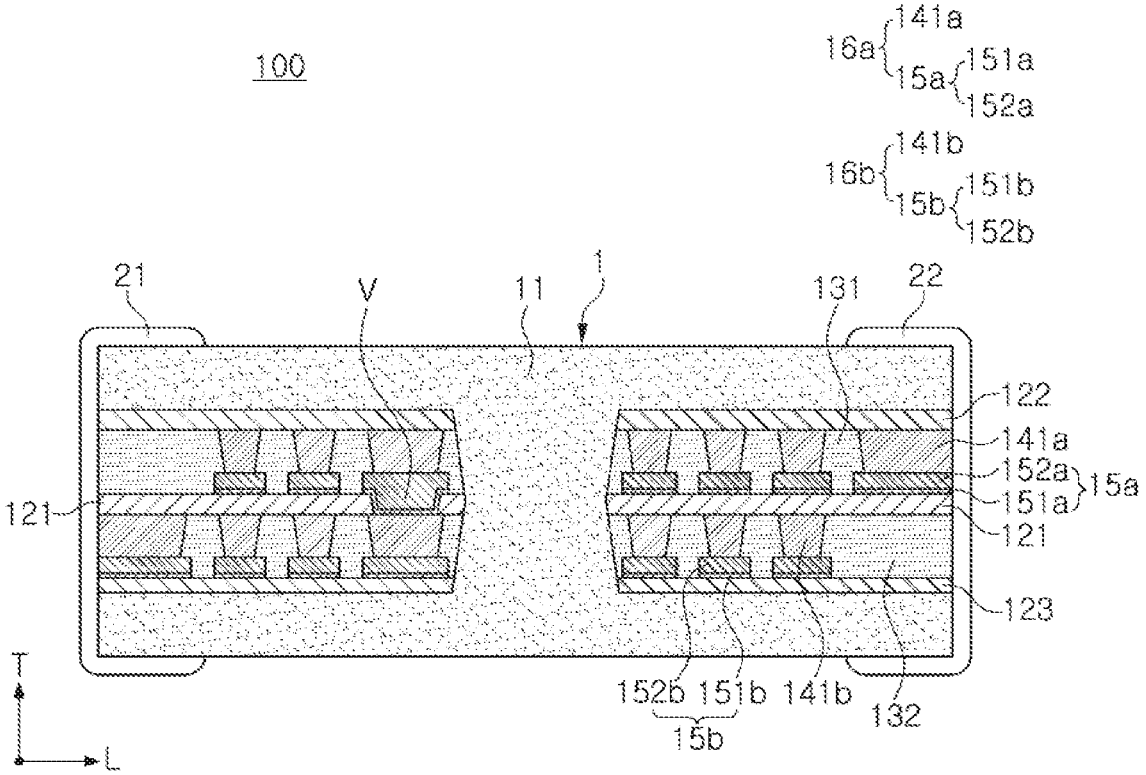
FIG. 2 is a schematic cross-sectional view of FIG. 1.

FIG. 1 is a schematic perspective view illustrating an inductor according to an exemplary embodiment in the present disclosure, and FIG. 2 is a schematic cross-sectional view taken along line I-I' of FIG. 1.

Referring to FIGS. 1 and 2, an inductor 100 may generally include a body 1 and first and second external electrodes 21 and 22 disposed on external surfaces of the body 1.

The body 1 may have an upper surface and a lower surface opposing each other in a thickness direction T, a first end surface and a second end surface opposing each other in a length direction L, and a first side surface and a second side surface opposing each other in a width direction W to thus substantially have a hexahedral shape, but is not limited thereto.

The body may be formed by filling a magnetic material 11 such as ferrite or a metal based soft magnetic material. The ferrite may include any ferrite materials known in the art, such as Mn—Zn based ferrite, Ni—Zn based ferrite, Ni—Zn—Cu based ferrite, Mn—Mg based ferrite, Ba based ferrite, Li based ferrite, or the like. The metal based soft magnetic material may be an alloy including one or more metal elements selected from the group consisting of Fe, Si, Cr, Al, and Ni. For example, the metal based soft magnetic material may include Fe—Si—B—Cr based amorphous metal particles, but is not limited thereto. The metal based soft magnetic material may have a particle diameter in a range from 0.1 to 20 μm, and may be included in a polymer such as an epoxy resin, polyimide, or the like, in a form in which it is dispersed on the polymer.

An insulating material and a coil may be encapsulated by the magnetic material 11 in the body 1.

The coil may be implemented to have an overall spiral shape, but is not limited thereto.

Structures of the insulating material and the coil will be described in more detail with reference to FIG. 2.

First, a first insulating film 121 including a via electrode V may have a thin film shape having a thickness of approximately 30 μm. A material of the first insulating film 121 may be Ajinomoto Build-up Film (ABF), polyimide, FR-4, Bismaleimide Triazine (BT), or the like. The first insulating film 121 may include a through-hole formed in the center thereof, and the through-hole may be filled with the magnetic material 11 to serve as a magnetic core.

The first insulating film 121 may serve as a boundary surface between a first insulating portion 131 and a second insulating portion 132, the first and second insulating portions 131 and 132 may be in contact with upper and lower surfaces of the first insulating film 121, respectively, and the upper and lower surfaces of the first insulating film 121 may be boundary surfaces of the first and second insulating portions 131 and 132, respectively.

Each of the first and second insulating portions 131 and 132 may have a thickness of approximately 50 μm or more to 70 μm or less, and an upper coil 16*a* and a lower coil 16*b* may be embedded in the first and second insulating portions 131 and 132, respectively, and the thickness of each of the first and second insulating portions 131 and 132 may thus be substantially the same as that of each of the upper coil 16*a* and the lower coil 16*b*.

The first and second insulating portions 131 and 132 may be formed of a material that is the same as or different from that of the first insulating film 121 in contact with the first and second insulating portions 131 and 132, for example, the material may include FR-4, BT, polyimide, or the like. Even though the first and second insulating portions 131 and 132 and the first insulating film 121 are formed of the same material, a boundary between the first insulating film 121 and the first insulating portion 131 and a boundary between the first insulating film 121 and the second insulating portion 132 may be apparent. The reason of the apparent boundary is that the first insulating film 121, the first insulating portion 131, and the second insulating portion 132 are formed by individual stacking processes.

The upper coil 16*a* may include first via pads 15*a* and first plating layers 141*a*, and the lower coil 16*b* may include second via pads 15*b* and second plating layers 141*b*.

The upper and lower coils 16*a* and 16*b* may be configured to have an overall spiral shape.

In the upper coil 16*a*, both end portions of the first via pad 15*a* may include protrusion portions, and the protrusion portions may be formed since an area of a lower portion of the first plating layer 141*a* disposed on the first via pad 15*a* is smaller than that of an upper surface of the first via pad 15*a*. The first plating layer 141*a* may have an area narrowed in a downward direction to have a cross section having a tapered shape on the whole.

Likewise, in the lower coil 16*b*, both end portions of the second via pad 15*b* may include protrusion portions, and the protrusion portions may be formed since an area of a lower portion of the second plating layer 141*b* disposed on the second via pad 15*b* is smaller than that of an upper surface of the second via pad 15*b*. The second plating layer 141*b* may have an area that becomes narrowed toward a downward direction to have a cross section having a tapered shape on the whole.

In addition, the first via pads 15*a* may include first metal thin film layers 151*a* and first metal pattern layers 152*a* disposed on the first metal thin film layers 151*a*, and the second via pads 15*b* may include second metal thin film layers 151*b* and second metal pattern layers 152*b* disposed on the second metal thin film layers 151*b*. In this case, one of first via pads 15*a* close to the through-hole may fill the via electrode V to connect the upper coil 16*a* and the lower coil 16*b* to each other. In more detail, the first metal thin film layer 151*a* in the first via pad 15*a* may be thinly coated on side surfaces and a lower surface of a via hole formed in the first insulating film 121, the first metal pattern layer 152*a* may be disposed on the first metal thin film layer 151*a*, and may be completely filled in the via hole.

Each of the first and second via pads 15*a* and 15*b* may have a thickness of approximately 15 μm, and such a thickness may be appropriately changed in consideration of an aspect ratio (AR) of the coil and an entire size of the inductor 100.

Next, each of the first and second plating layers 141*a* and 141*b* may serve to substantially determine the AR of the coil, and when a coil having a high AR is required, thicknesses of the first and second plating layers 141*a* and 141*b* may be increased or a plurality of plating layers may be stacked using a plurality of processes.

A second insulating film 122 may be further disposed between an upper surface of the upper coil 16*b* and the magnetic material to implement electrical insulation between the upper coil 16*a* and the magnetic material. Likewise, a third insulating film 123 may be further disposed between a lower surface of the lower coil 16*b* and the magnetic material to implement electrical insulation between the lower coil 16*b* and the magnetic material. Each of the second and third insulating films 122 and 123 may have a thickness of approximately 10 μm. A material of each of the second and third insulating films 122 and 123 may be ABF (epoxy and hardener) or a photoimagable dielectric (PID) resin, and may be any material having a thin film shape and an excellent insulating property and molding property.

Figure 3A:
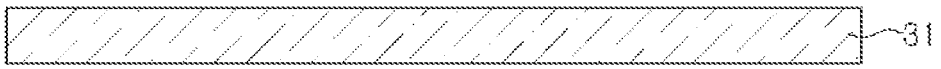
FIGS. 3A through 3U are views illustrating an example of a method of manufacturing the inductor of FIGS. 1 and 2.
Figure 3B:
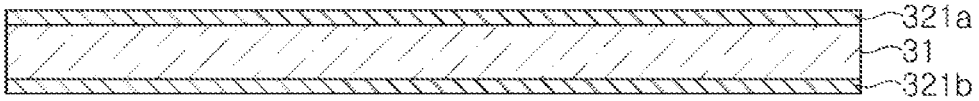
Figure 3C:
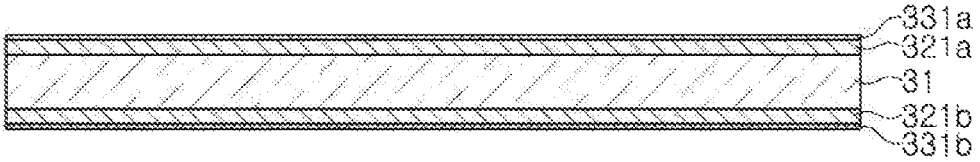
Figure 3D:
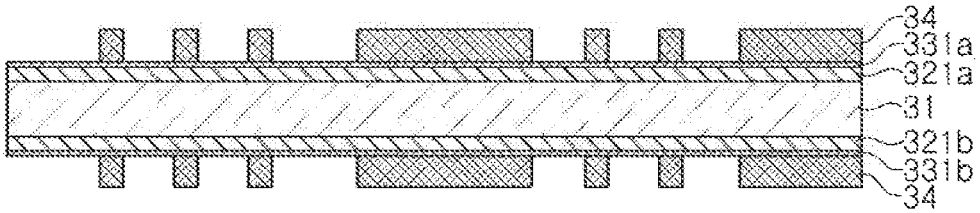
Figure 3E:
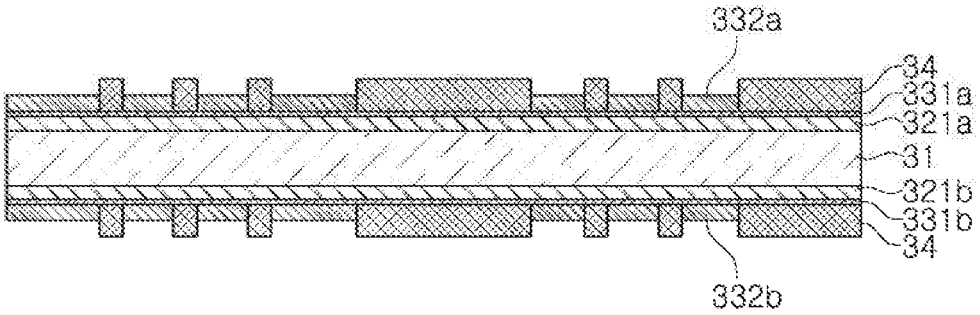
Figure 3F:
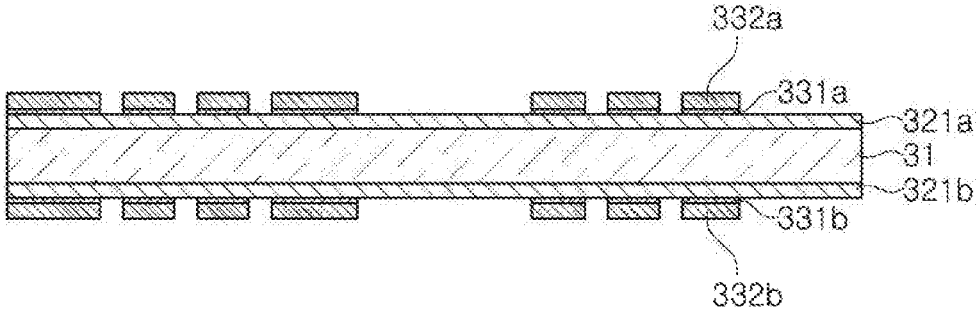
Figure 3G:
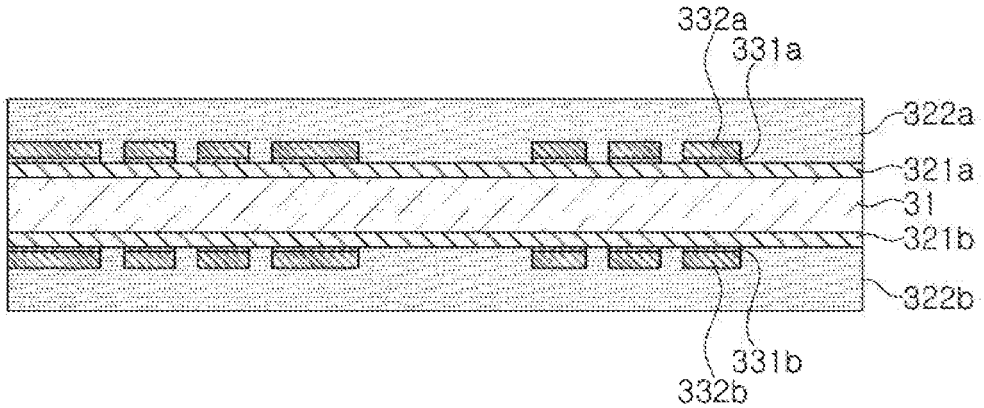
Figure 3H:
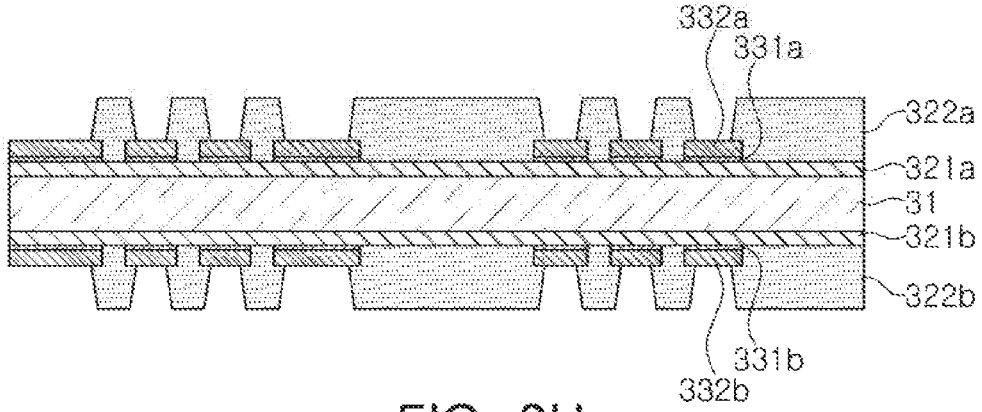
Figure 3I:
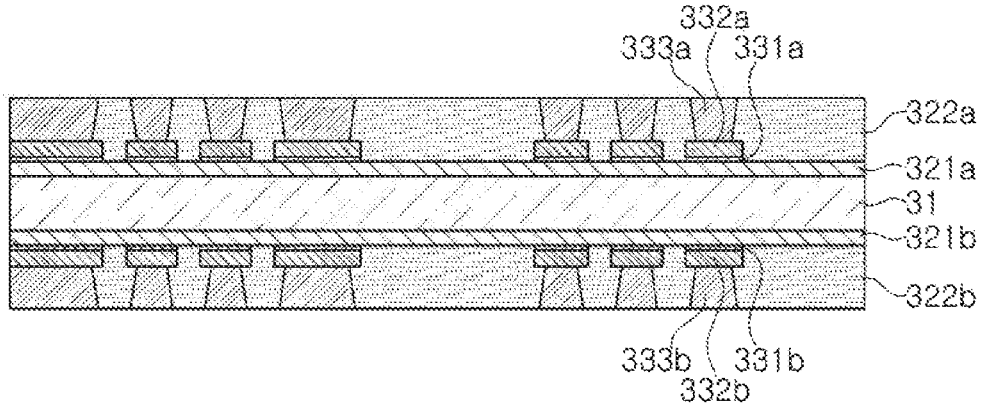
Figure 3J:
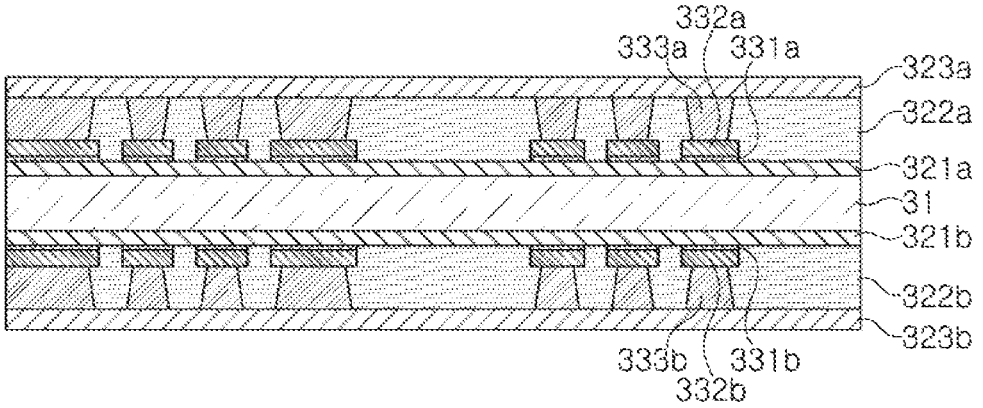
Figure 3K:
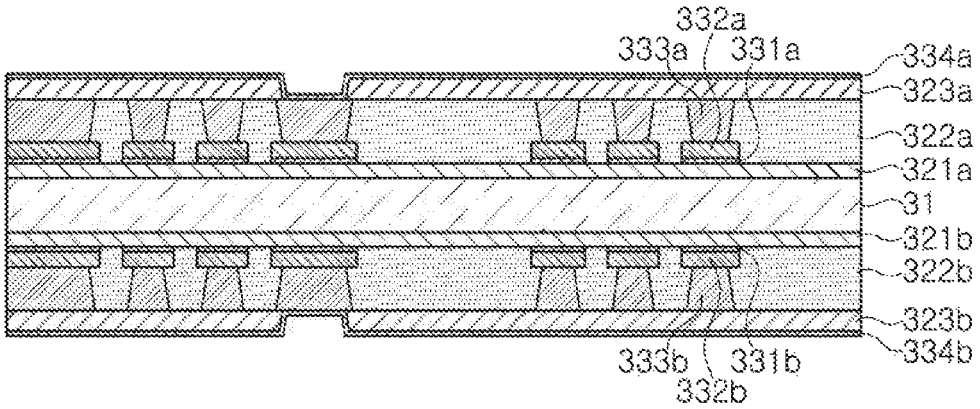
Figure 3L:
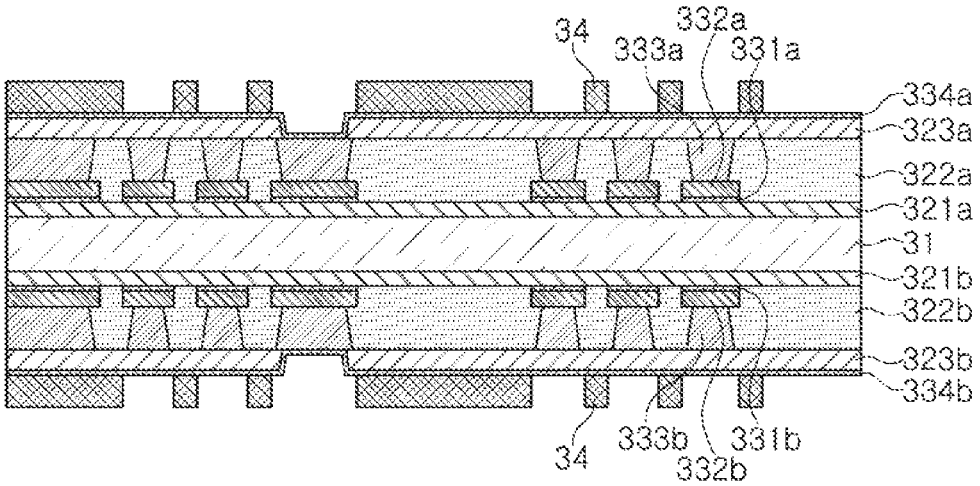
Figure 3M:
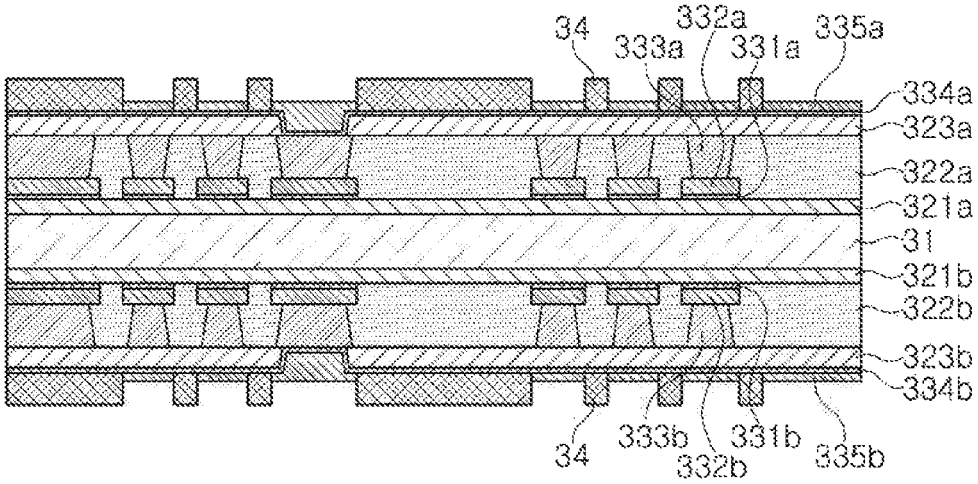
Figure 3N:
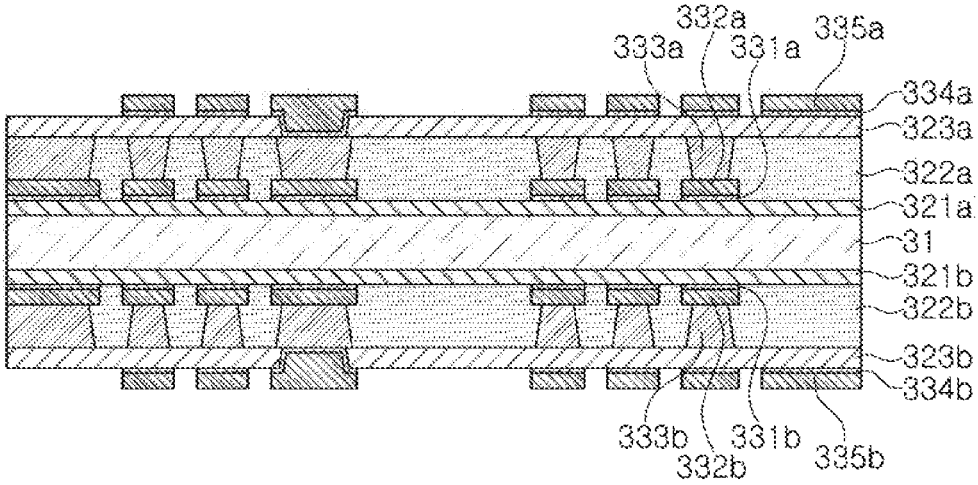
Figure 3O:
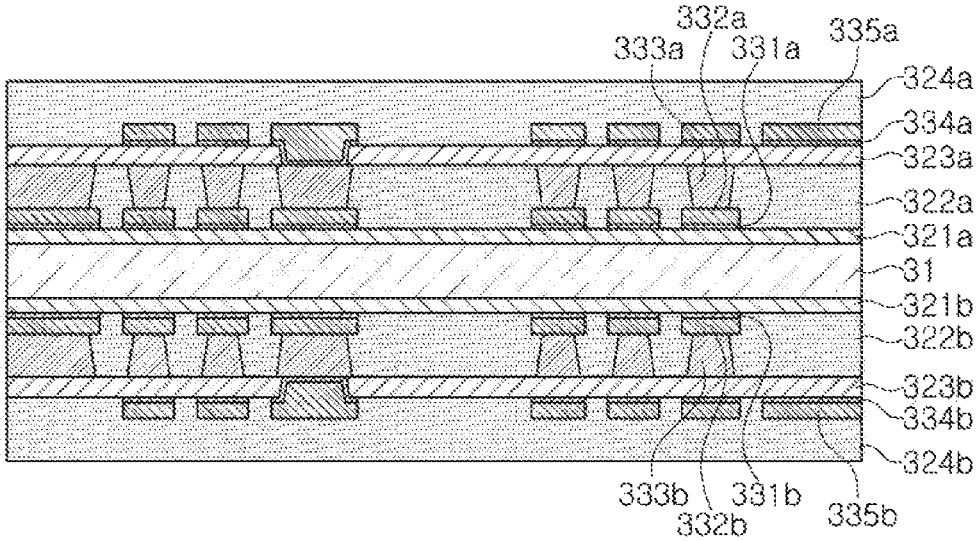
Figure 3P:
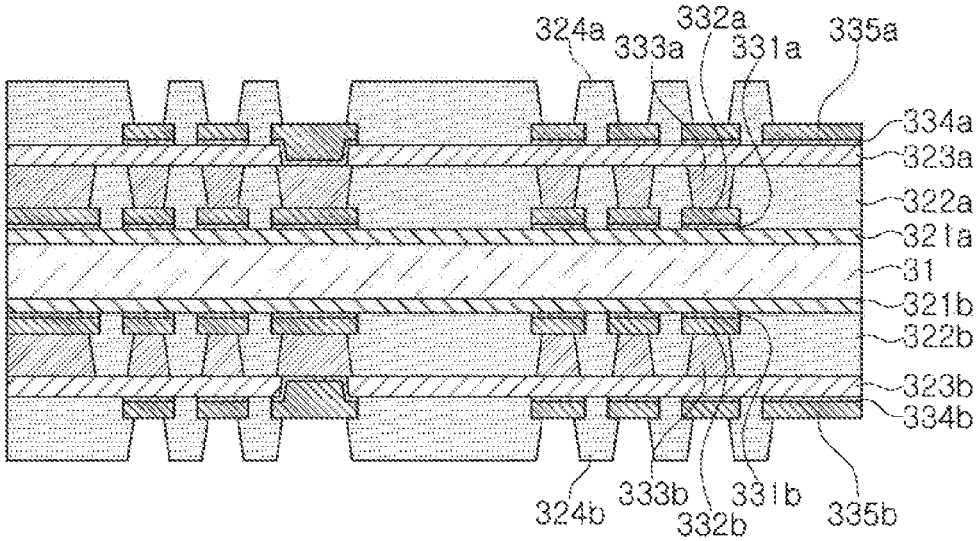
Figure 3Q:
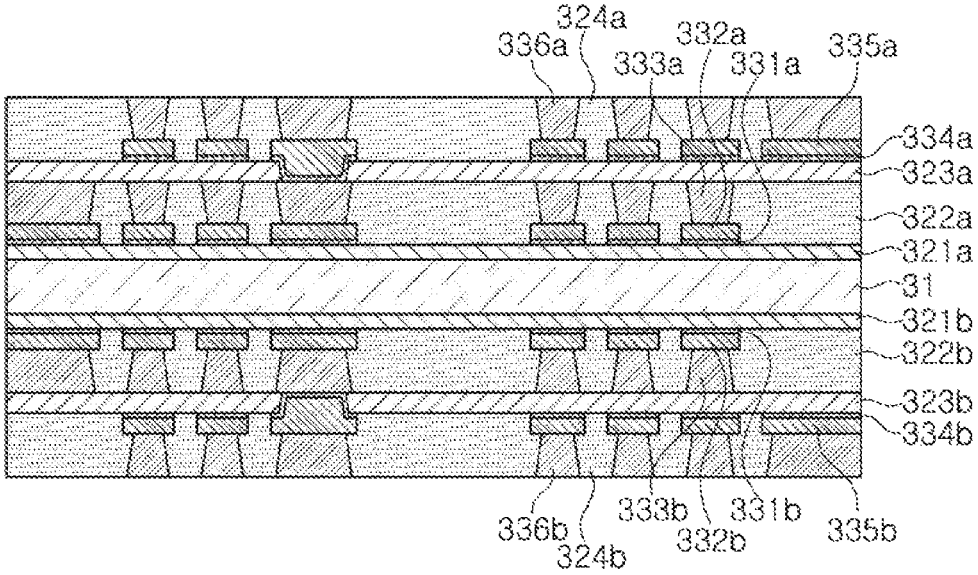
Figure 3R:
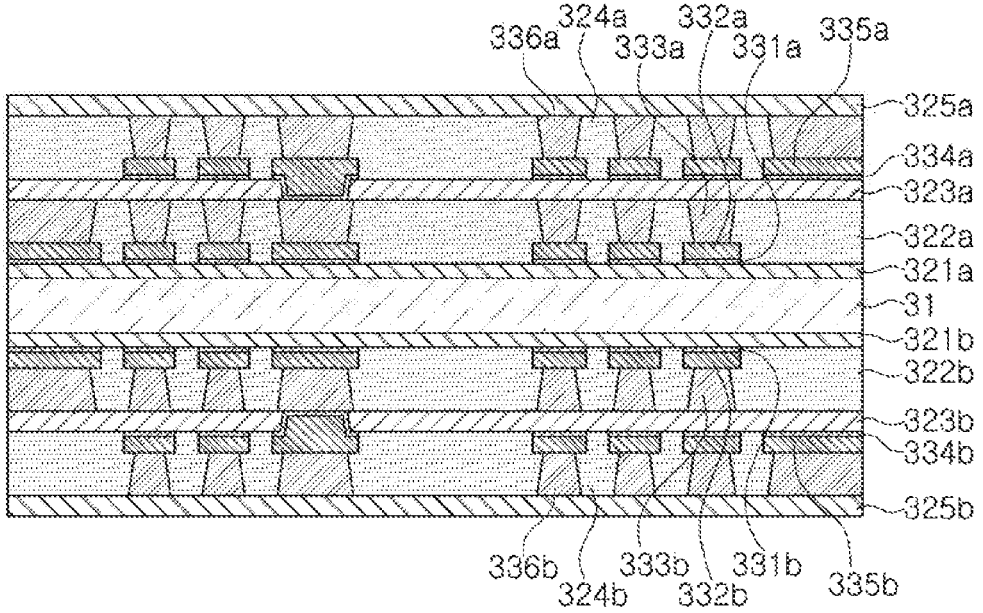
Figure 3S:
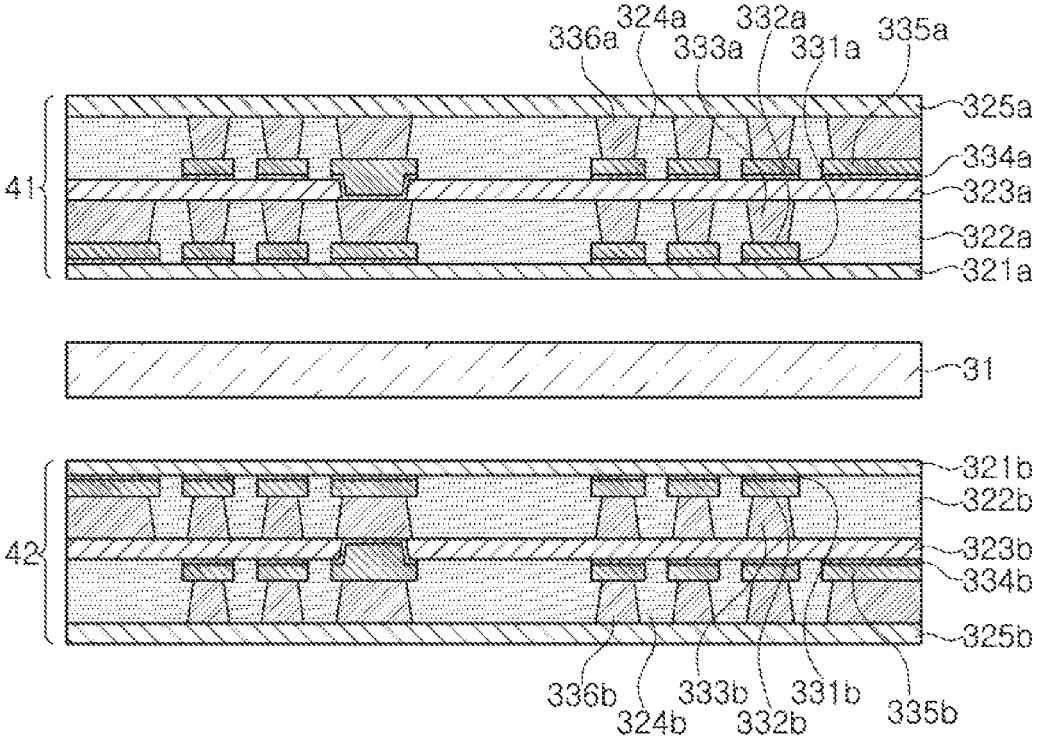
Figure 3T:
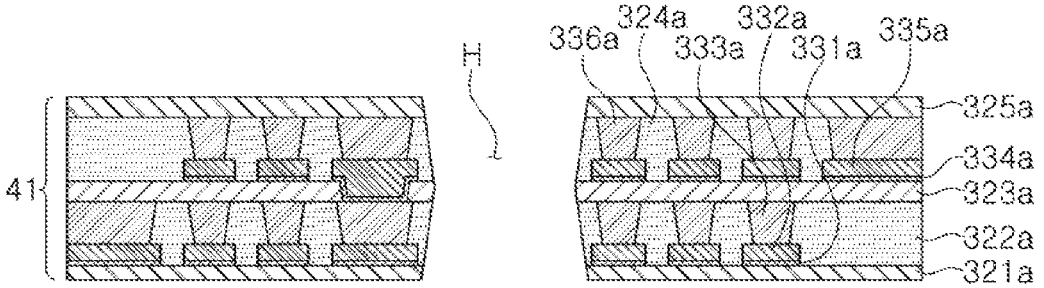
Figure 3U:
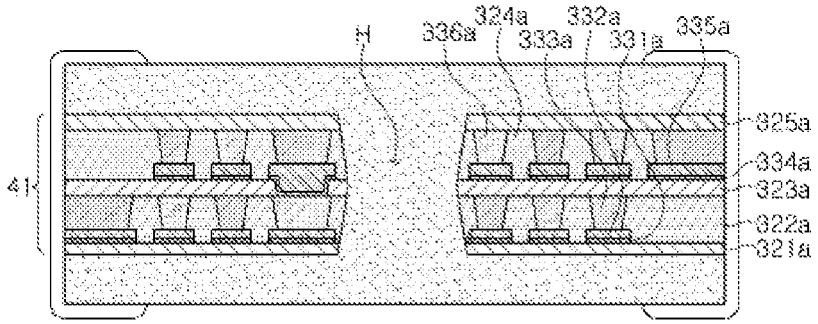

FIGS. 3A through 3U are schematic views illustrating processes of a method of manufacturing the inductor 100 of FIG. 2. For convenience of explanation, terms such as "first", "second", and the like, will be mentioned in a sequence in which the respective components are formed, and may be irrelevant to the sequence of manufacturing the inductor 100 described above.

FIG. 3A illustrates a process of preparing a support member 31. Any support member having insulating properties and having a thin film shape may be used as the support member 31. For example, the support member 31 may be formed by removing copper foil layers disposed on upper and lower surfaces of an existing copper clad laminate (CCL) core from the CCL core. A specific thickness of the support member 31 is not limited. That is, the support member 31 may have a thickness enough to appropriately perform a support member, and may have a thickness of approximately 60 μm to utilize existing equipment as it is.

Then, as illustrated in FIG. 3B, first insulating films 321*a* and 321*b* may be applied to upper and lower surfaces of the support member 31, respectively. A manner of applying the first insulating films 321*a* and 321*b* is not limited, but may be a lamination process. In addition, a material of each of the first insulating films 321*a* and 321*b* may be ABF (epoxy+hardener), a photoimagable dielectric (PID) resin, polyimide, and a thickness thereof may be approximately 10 μm, but is not limited thereto.

FIG. 3C illustrates a process of forming first thin film plating layers 331*a* and 331*b* on the first insulating films 321*a* and 321*b*. Here, a material of each of the first thin film plating layers 331*a* and 331*b* may be any material having electrical conductivity, and may be generally copper (Cu). In addition, a manner of forming the first thin film plating layers 331*a* and 331*b* is not particularly limited, but may be a chemical plating manner or a sputtering manner and may be appropriately selected by those skilled in the art depending on process conditions and required specifications.

FIG. 3D illustrates a process of disposing patterned insulating patterns 34 on the first thin film plating layers 331*a* and 331*b*. The patterned insulating patterns 34 may be derived by exposing and developing dry films having a predetermined thickness to constitute patterns having a coil shape. In this case, a thickness or a shape of each of the patterned insulating patterns 34 is not limited, but may be appropriately selected, and a thickness of an opening of each of the patterned insulating patterns 34 may be greater than that of a metal pattern layer that is to be filled in each of the openings.

FIG. 3E illustrates a process of forming first metal pattern layers 332*a* and 332*b* filling the openings in the patterned insulating patterns 34. A manner of forming the first metal pattern layers 332*a* and 332*b* is not limited, but may be an electroplating manner using first metal thin film layers 151*a* disposed below the first metal pattern layers 332*a* and 332*b* as seeds. A material of each of the first metal pattern layers 332*a* and 332*b* is not limited, but may be copper (Cu). The first via pads 15*a* may be configured by combining the first metal pattern layers 332*a* and 332*b* and the first metal thin film layers 151*a* formed in advance below the first metal pattern layers 332*a* and 332*b* with each other.

FIG. 3F illustrates a process of removing the patterned insulating patterns 34 formed in FIG. 3D. In this case, the first metal pattern layers 332*a* and 332*b* in contact with lower portions of the patterned insulating patterns and the first metal thin film layers 151*a* may be removed together with the patterned insulating patterns, but a detailed description therefor is omitted. As described above, when the patterned insulating patterns 34 are removed, the first via pads 15*a* having a spiral shape on the whole and including the first metal thin film layers 151*a* and the first metal pattern layers 332*a* and 332*b* having a substantially rectangular cross section may be formed.

Then, FIG. 3G illustrates a process of laminating first insulating portions 322*a* and 322*b* on upper and lower surfaces of the first metal thin film layers 151*a* and the first metal pattern layers 332*a* and 332*b*. At least portions of the first insulating portions 322*a* and 322*b* remain in a final chip, and a thickness of the first insulating portions 322*a* and 322*b* may be substantially the same as a desired thickness of the coil. When the first insulating portions 322*a* and 322*b* are unnecessarily thick, a separate process of removing the first insulating portions 322*a* and 322*b* needs to be added, which is not efficient. A material of the first insulating portions 322*a* and 322*b* is not limited, and in particular, a degree of freedom of selection of a material of the first insulating portions 322*a* and 322*b* by those skilled in the art may be relatively high since the first insulating portions 322*a* and 322*b* are not patterned by printing process, but may be patterned by laser process, as described below.

Then, referring to FIG. 3H, the first insulating portions 322*a* and 322*b* may be patterned using a laser beam to have a shape corresponding to that of the first via pads 15*a* disposed therebelow, for example, a spiral shape. A process of patterning the first insulating portions 322*a* and 322*b* is not limited, but may be a laser process. A width of patterning may be appropriately controlled by changing a condition such as a beam size, or the like, in the laser process, and the first insulating portions 322*a* and 322*b* may be patterned to have a reverse trapezoidal cross section in which a width of a lower surface of an opening of the first insulating portion 322*a* or 322*b* facing the first via pad 15*a* is smaller than that of an upper surface thereof. In this case, a predetermined step may be formed between the opening of the first insulating portion 322*a* or 322*b* and an upper surface of the first metal pattern layer 332*a* or 332*b* of the first via pad 15*a*. Here, the predetermined step may be formed in a plating growth direction of the coil. In detail, an area of the lower surface of the opening of the first insulating portion 322*a* or 322*b* may be smaller than that of the upper surface of the first metal pattern layer 332*a* or 332*b*, such that an outer side portion of an upper surface of the first metal pattern layer 332*a* or 332*b* may be maintained in a state in which it is substantially covered with the first insulating portion 322*a* or 322*b*.

FIG. 3I illustrates a process of forming first plating layers 333*a* and 333*b* in the openings of the first insulating portions 322*a* and 322*b*. In this case, electroplating using the first via pads 15*a* as seeds may be used or those skilled in the art may appropriately select electroless plating, injection, or the like, in consideration of process conditions, or the like. A thickness of the first plating layer 333*a* and 333*b* may be substantially the same as that of the first insulating portion 322*a* or 322*b*. When the thickness of the first plating layer 333*a* and 333*b* is greater than that of the first insulating portion 322*a* or 322*b*, a short-circuit between adjacent plating layers 333*a* and 333*b* may be generated, and when the thickness of the first plating layer 333*a* and 333*b* is smaller than that of the first insulating portion 322*a* or 322*b* and a thin thickness level of the first plating layer 333*a* and 333*b* is greater than a contraction level of the first plating layer 333*a* and 333*b* depending on a subsequent process or an environment, a separate removing process needs to be further performed, which is not efficient.

FIG. 3J illustrates a process of laminating second insulating films 323*a* and 323*b* on the first insulating portions 322*a* or 322*b* and the first plating layers 333*a* and 333*b*. Since the second insulating films 323*a* and 323*b* are spaces in which via electrodes V are formed, the second insulating films 323*a* and 323*b* may be formed at a thickness enough to support the via electrodes V, substantially, approximately 30 μm.

Then, FIG. 3K illustrates a process of forming via holes in the second insulating films 323*a* and 323*b* and forming second metal thin film layers 334*a* and 334*b* on surfaces of the second insulating films 323*a* and 323*b* and the via holes. At least portions of the first plating layers 333*a* and 333*b* embedded below the second insulating films 323*a* and 323*b* may be exposed by forming the via holes. Therefore, the first plating layers 333*a* and 333*b* and the second metal thin film layers 334*a* and 334*b* may be in contact with each other through the via holes.

FIG. 3L illustrates a process of disposing patterned insulating patterns 34. This process may be substantially the same as the process of disposing the patterned insulating patterns 34 described in FIG. 3D.

Then, FIG. 3M illustrates a process of filling second metal pattern layers 335*a* and 335*b* in openings of the patterned insulating patterns 34. A manner of filling the second metal pattern layers 335*a* and 335*b* is not limited, but may be, for example, a manner of performing plating using the second metal thin film layers 334*a* and 334*b* as seeds.

FIG. 3N illustrates a process of removing the patterned insulating patterns 34. In this case, the second metal thin film layers 334*a* and 334*b* disposed below the patterned insulating patterns 34 may also be removed. Resultantly, second via pads 15*b* may be substantially derived in FIG. 3N. Here, the second via pads 15*b* may include the second metal thin film layers 334*a* and 334*b* and the second metal pattern layers 335*a* and 335*b* stacked on the second metal thin film layers 334*a* and 334*b*. The second via pads 15*b* may fill the via holes to form via electrodes V, and may have a spiral shape on the whole.

FIG. 3O illustrates a process of encapsulating the second via pads 15*b* with second insulating portions 324*a* and 324*b*, for example, a process of laminating the second insulating portions 324*a* and 324*b*. The second insulating portions 324*a* and 324*b* may be formed by a process that is substantially the same as that of forming the first insulating portions 322*a* or 322*b* described above.

FIG. 3P illustrates a process of patterning the second insulating portions 324*a* and 324*b* so that the second insulating portions 324*a* and 324*b* have openings. In this case, the second insulating portions 324*a* and 324*b* may be patterned using a laser beam rather than a photolithography. A cross section of the opening may have a reverse trapezoidal shape in which a lower surface thereof is narrower than an upper surface thereof. Sizes or specific shapes of cross sections of the openings in each position may be appropriately changed by those skilled in the art by adjusting beam sizes.

FIG. 3Q illustrates a process of filling the openings of the second insulating portions 324*a* and 324*b* with second plating layers 336*a* and 336*b*. Here, a manner of filling the openings of the second insulating portions 324*a* and 324*b* with the second plating layers 336*a* and 336*b* may be an electroplating manner, an electroless plating manner, or the like. A thickness of the second plating layer 336*a* or 336*b* may be substantially the same as that of the second insulating portion 324*a* or 324*b*. When the thickness of the second plating layer 336*a* or 336*b* is greater than that of the second insulating portion 324*a* or 324*b*, a short-circuit between adjacent plating layers 336*a* and 336*b* may be generated, and when the thickness of the second plating layer 336*a* or 336*b* is smaller than that of the second insulating portion 324*a* or 324*b* and a thin thickness level of the second plating layer 336*a* or 336*b* is greater than a contraction level of the second plating layer 336*a* or 336*b* depending on a subsequent process or an environment, a separate removing process needs to be further performed, which is not efficient.

FIG. 3R illustrates a process of laminating third insulating films 325*a* and 325*b* on the second plating layers 336*a* and 336*b*. Here, the third insulating layers 325*a* and 325*b* may have a uniform thickness on the whole, for example, approximately 10 μm.

FIG. 3S illustrates a process of separately separating the support member 31 to form a plurality of bodies. Resultantly, at least two bodies may be formed above and below the support member 31, which is advantageous in improving symmetry between the bodies and a yield.

FIG. 3T illustrates a process of drilling a through-hole H penetrating through a central portion of the body. The through-hole H may be filled with a magnetic material in a subsequent process to improve magnetic permeability of a core.

FIG. 3U illustrates a process of filling the magnetic material in the body to encapsulate coils and insulating portions on the whole, processing opposite end portions of the body through a dicing blade (not illustrated), and forming external electrodes on the opposite end portions of the body.

A description for features overlapping those of the inductor according to the exemplary embodiment in the present disclosure described above except for the abovementioned description is omitted.

Figure 4:
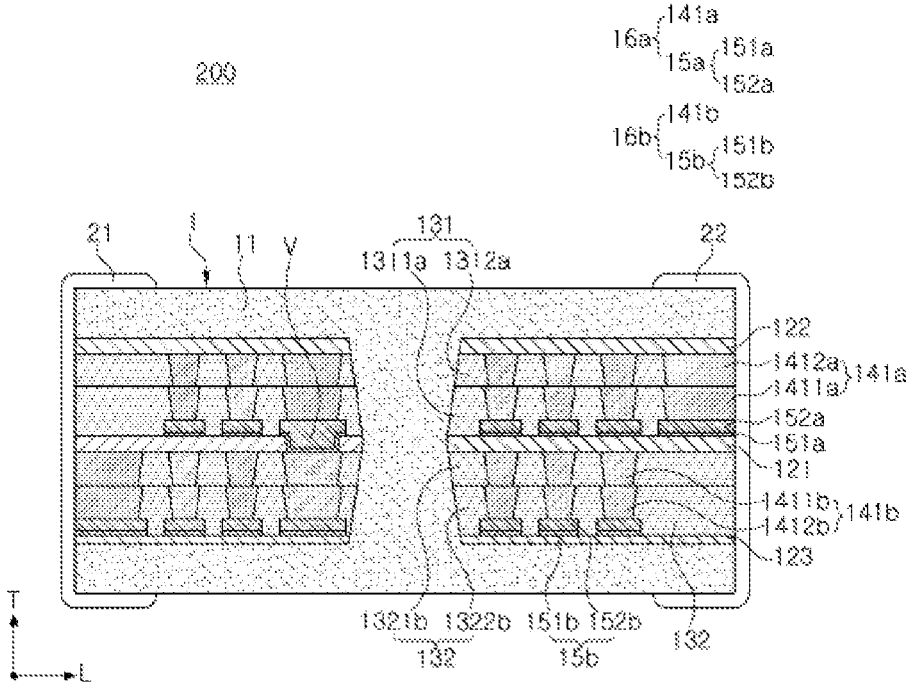
FIG. 4 is a schematic cross-sectional view illustrating an inductor according to a modified example of FIG. 2.
Figure 5:
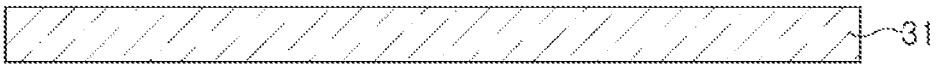
FIGS. 5 through 31 are views illustrating an example of a method of manufacturing the inductor of FIG. 4.
Figure 6:
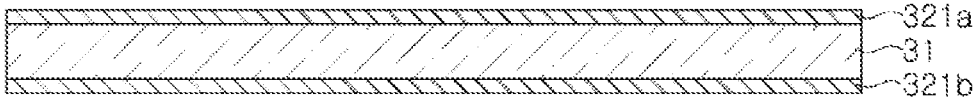
Figure 7:
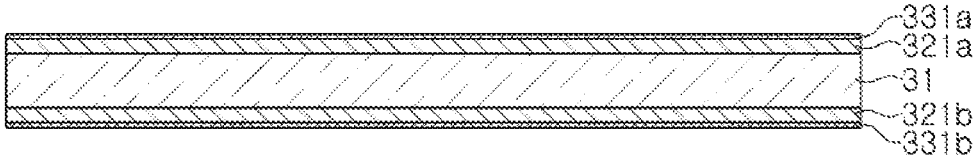
Figure 8:
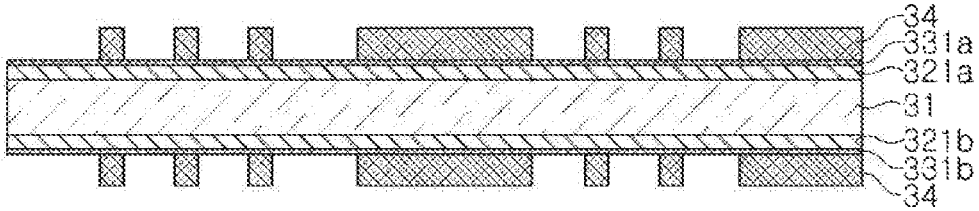
Figure 9:
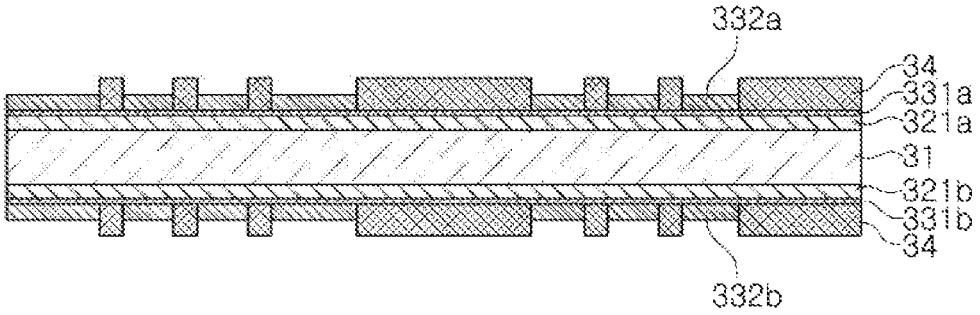
Figure 10:
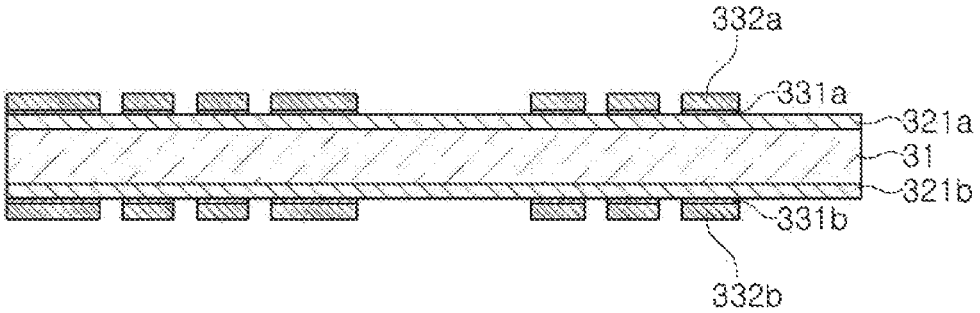
Figure 11:
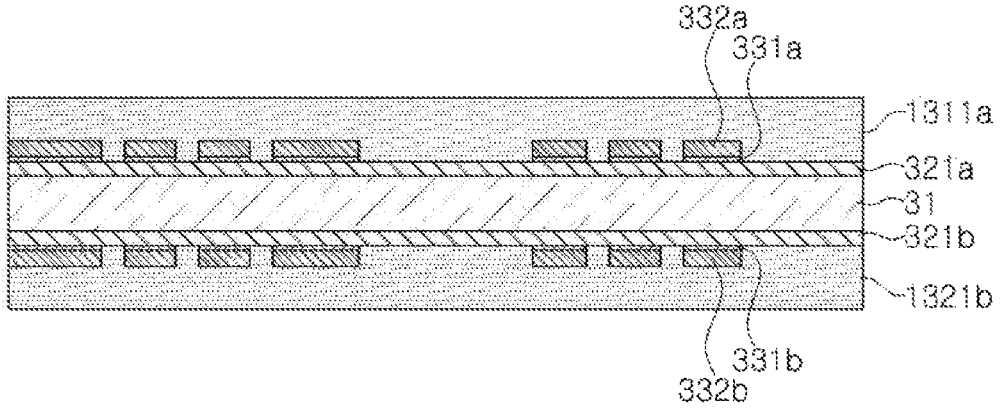
Figure 12:
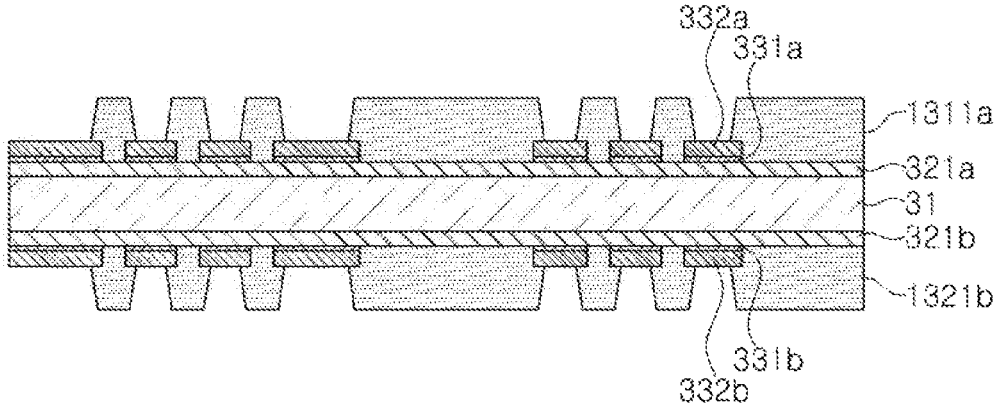
Figure 13:
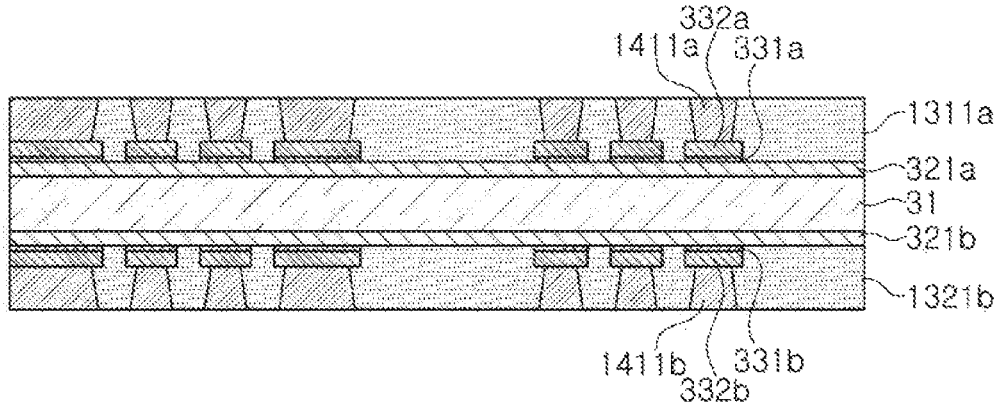

Next, FIG. 4 illustrates an inductor 200 modified from the inductor 100 illustrated in FIG. 2. The inductor 200 may be substantially the same as the inductor 100 illustrated in FIG. 2 except that first and second plating layers 141*a* and 141*b* are formed of a plurality of plating layers (two plating layers) to increase an aspect ratio of a coil. The same components are denoted by the same reference numerals for convenience of explanation, and a description for components overlapping with the components described above is omitted.

Referring to FIG. 4, first plating layers 141*a* may include first plating patterns 1411*a* and second plating patterns 1412*a*, which are patterns corresponding to each other, and second plating layers 141*b* may include first plating patterns 1411*b* and second plating patterns 1412*b*, which are patterns corresponding to each other. In this case, the second plating patterns 1412*a* and 1412*b* may be disposed on the first plating patterns 1411*a* and 1411*b*, respectively, and the first plating patterns 1411*a* and 1411*b* and the second plating patterns 1412*a* and 1412*b* may have cross-sectional shapes of coils that are substantially the same as each other. The first and second plating patterns 1411*a*, 1411*b*, 1412*a*, and 1412*b* may be directly connected to each other or be connected to each other through an insulating layer interposed therebetween and having a predetermined thickness. In addition, first insulating patterns 1311*a* insulating the first plating patterns 1411*a* of the first plating layers 141*a* and second insulating patterns 1312*a* insulating the second plating patterns 1412*a* of the first plating layer 141*a* may constitute a first insulating portion 131, and first insulating patterns 1321*b* insulating the first plating patterns 1411*b* of the second plating layers 141*b* and second insulating patterns 1322*b* insulating the second plating patterns 1412*b* of the second plating layer 141*b* may constitute a second insulating portion 132. The second insulating patterns 1322*b* may also be disposed on the first insulating patterns 1311*a* as in a disposition of the first and second plating patterns 1411*a*, 1411*b*, 1412*a*, and 1412*b*, and the first and second insulating patterns 1311*a* and 1312*a* may be directly connected to each other or be connected to each other through a predetermined component interposed therebetween.

The inductor 200 may have an Rdc value significantly reduced as compared to an inductor in which each of the first and second plating layers 141*a* and 141*b* is formed of only a single plating pattern.

Next, FIGS. 5 through 31 are schematic views illustrating processes of a method of manufacturing the inductor 200 of FIG. 4. Most of the respective processes of the method illustrated in FIGS. 5 through 31 overlap those of the method illustrated in FIGS. 3A through 3U, but some of them are different from those of the method illustrated in FIGS. 3A through 3U. Therefore, processes illustrated in FIGS. 14 through 16 and FIGS. 25 through 27, which are processes different from the processes illustrated in FIGS. 3A through 3U among processes illustrated in FIGS. 5 through 31, will be described in detail.

Figure 14:
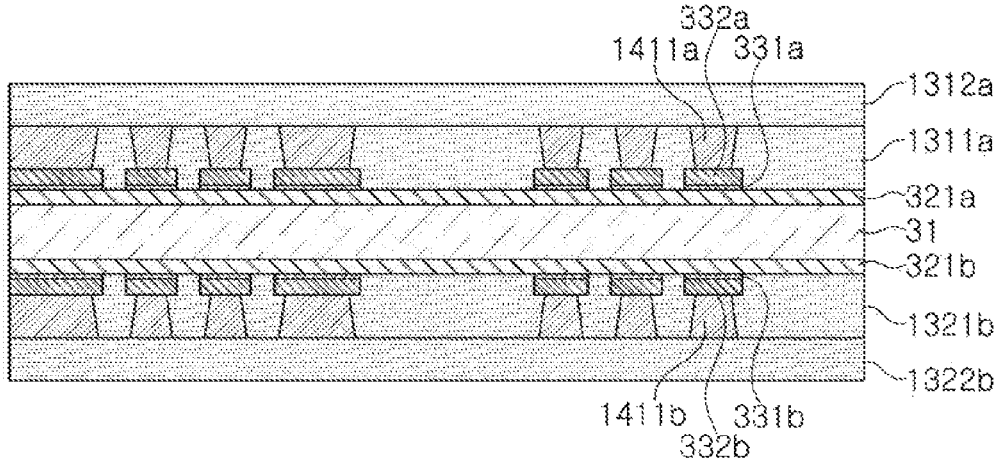
Figure 15:
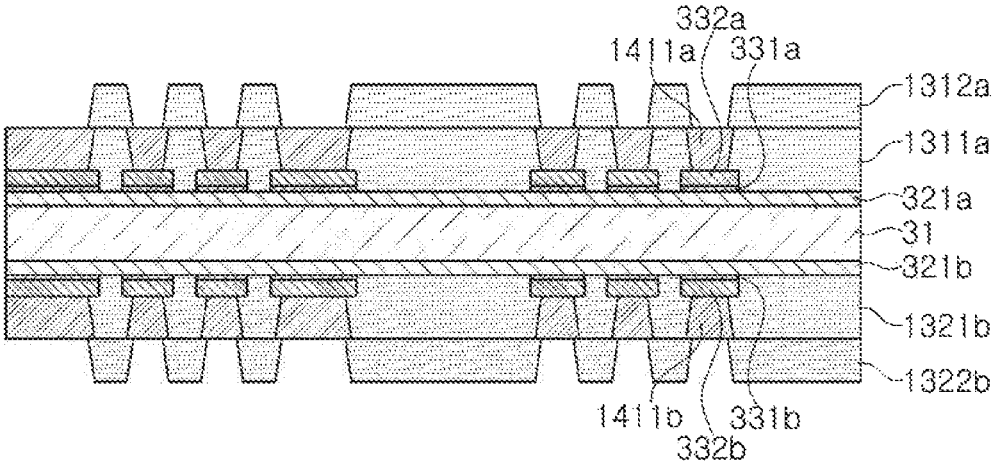
Figure 16:
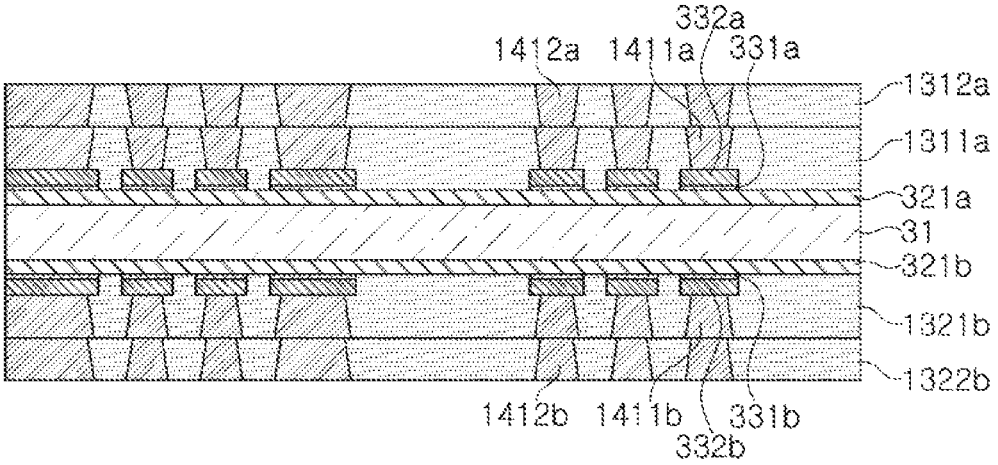
Figure 17:
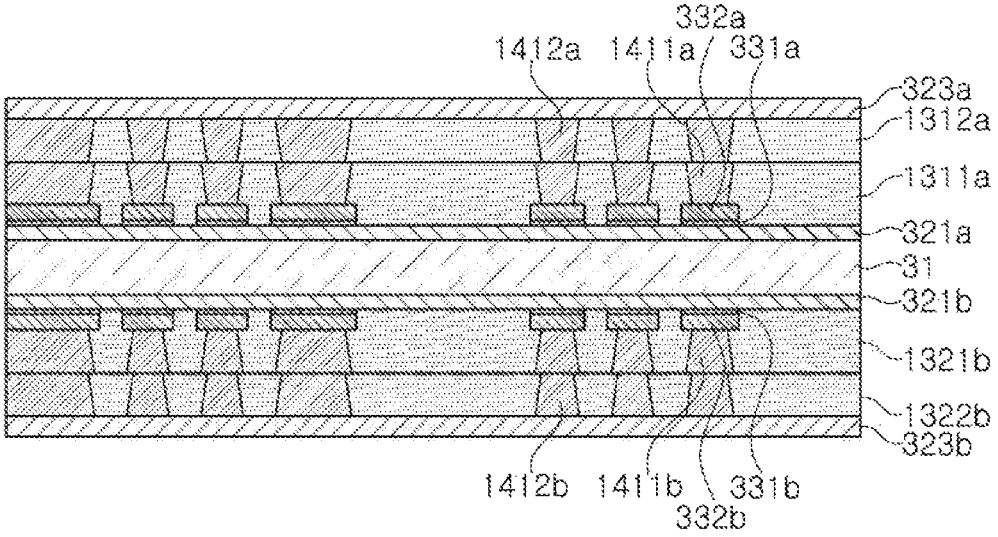
Figure 18:
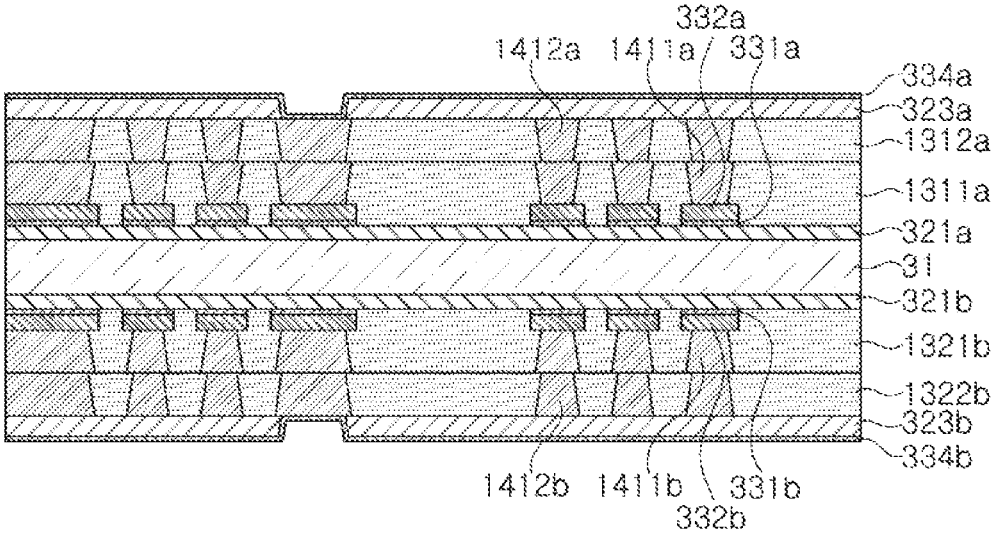
Figure 19:
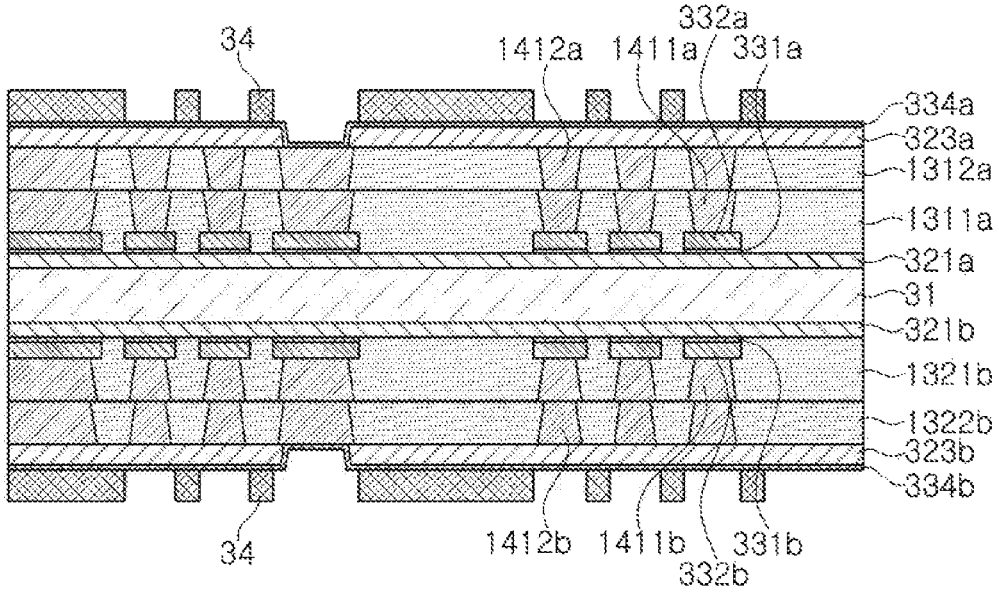
Figure 20:
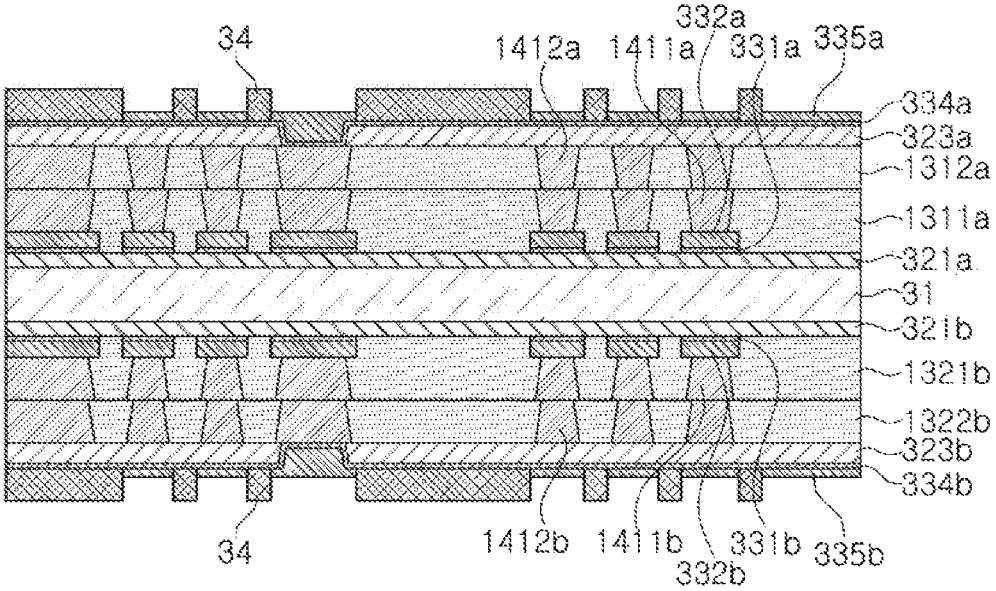
Figure 21:
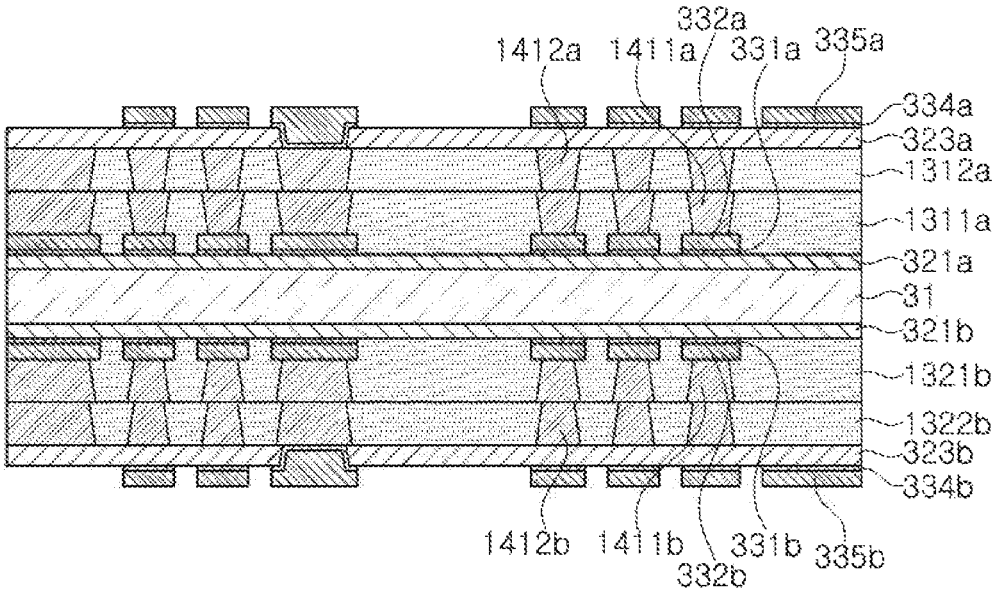
Figure 22:
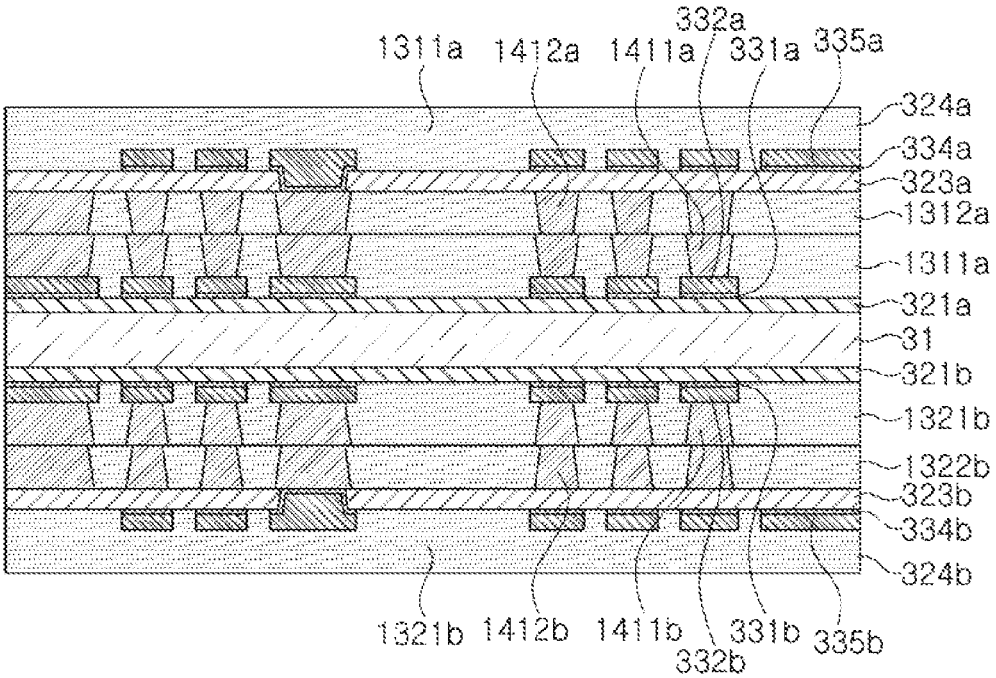
Figure 23:
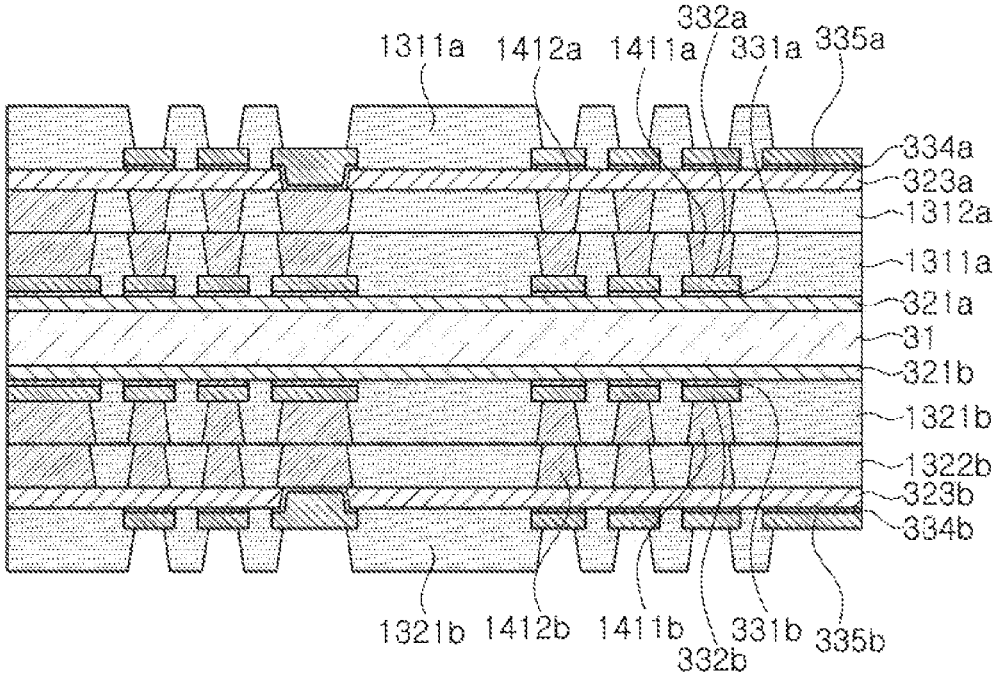
Figure 24:
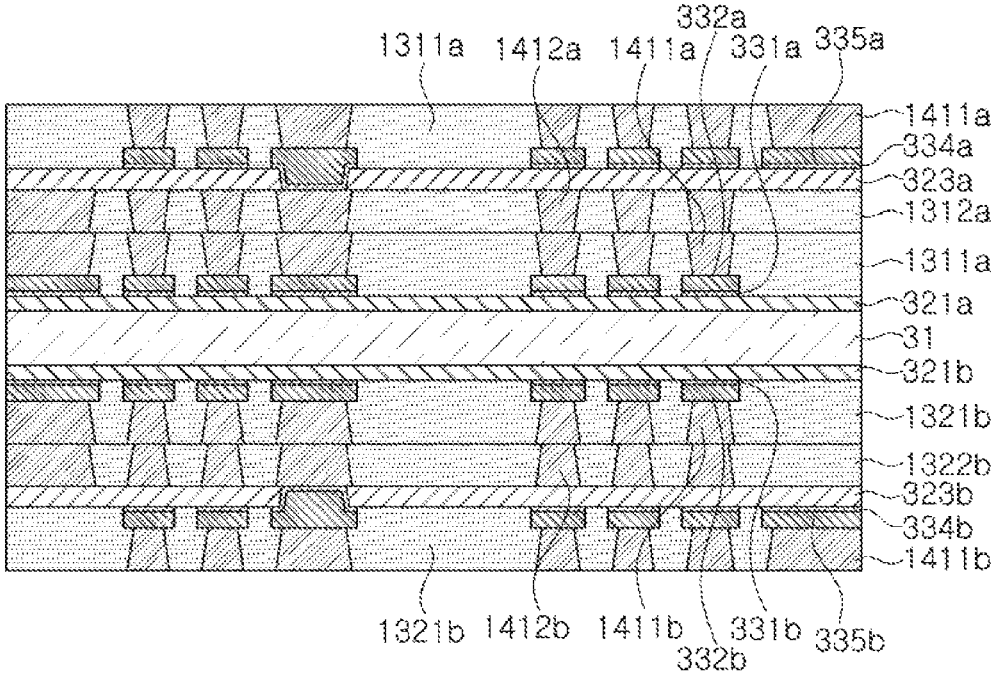

First, referring to FIGS. 14 through 16, unlike FIGS. 3A through 3U, a first insulating portion 1312*a* that is the same as a first insulating portion 1311*a* may be additionally stacked (see FIG. 14), instead of laminating a second insulating film for drilling a via hole after first plating layers 1411*a* and 1411*b* are formed. Then, the first insulating portion 1312*a* may be patterned using a laser beam to form openings penetrating through the first insulating portion 1312*a* (see FIG. 15), and first plating layers 1412*a* may be formed in the openings (see FIG. 16). Resultantly, the first plating layers 1412*a* may be directly stacked on the first plating layers 1411*a* that are the same as the first plating layers 1412*a*. In this case, the first plating layers (1411*a*+1412*a*) having an AR higher than that of the first plating layers 333*a* and 333*b* of FIGS. 3A through 3U may be derived, such that Rdc characteristics of the inductor may be significantly improved.

Figure 25:
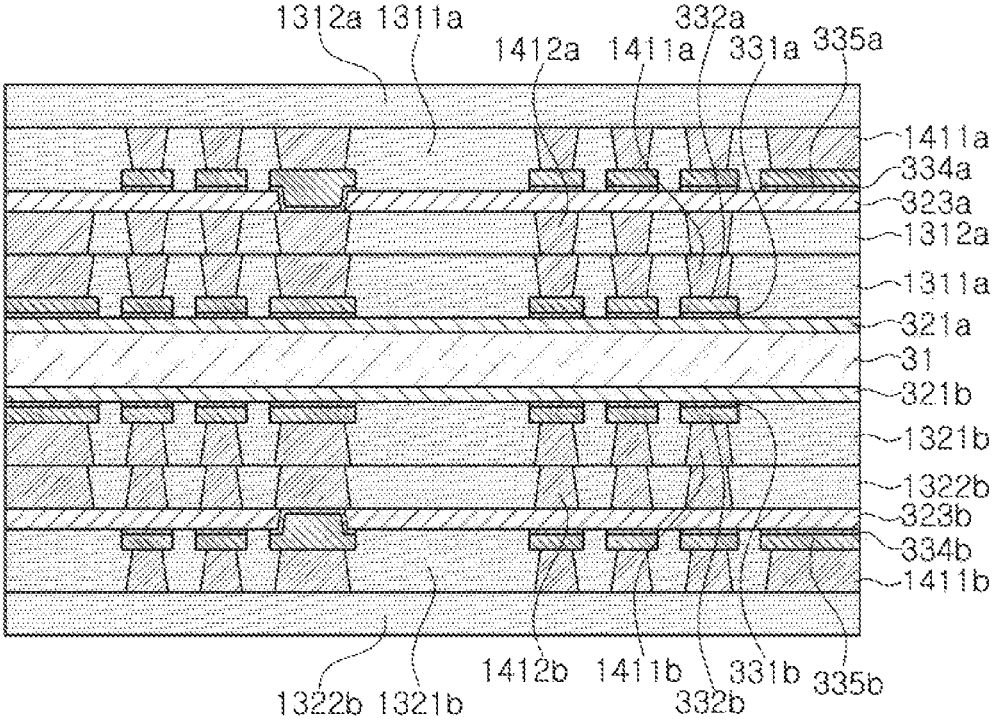
Figure 26:
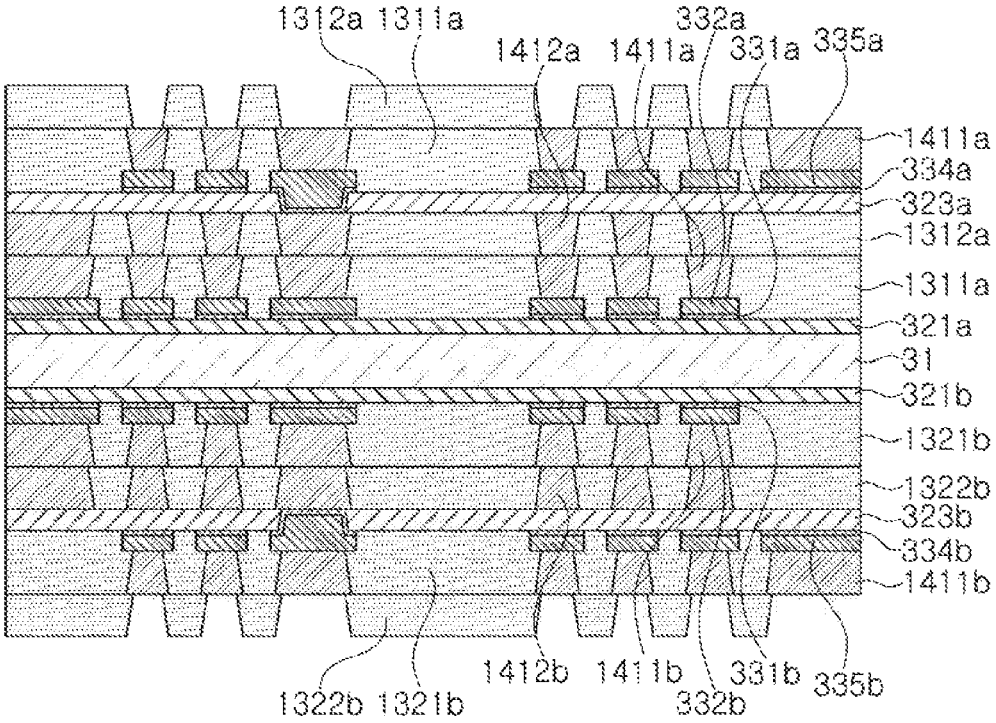
Figure 27:
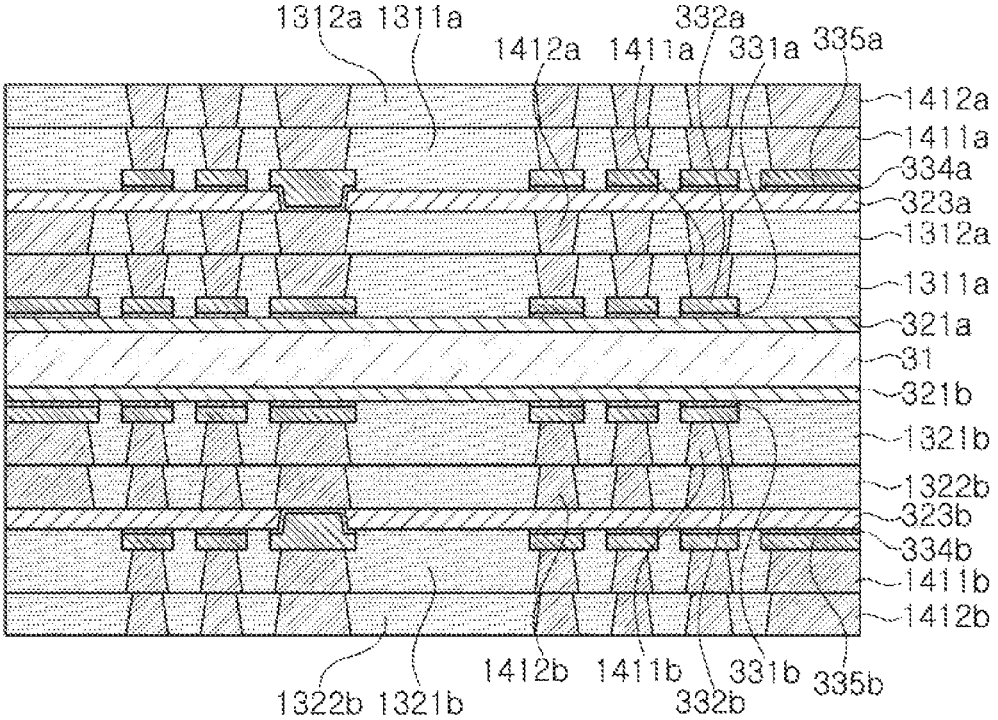
Figure 28:
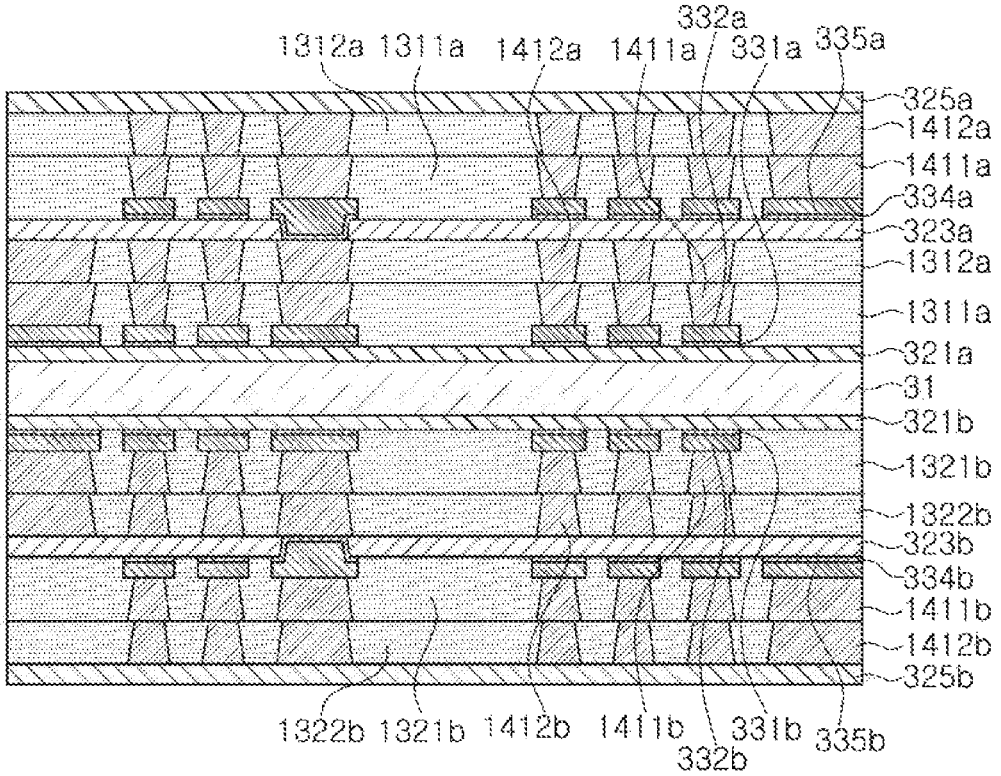
Figure 29:
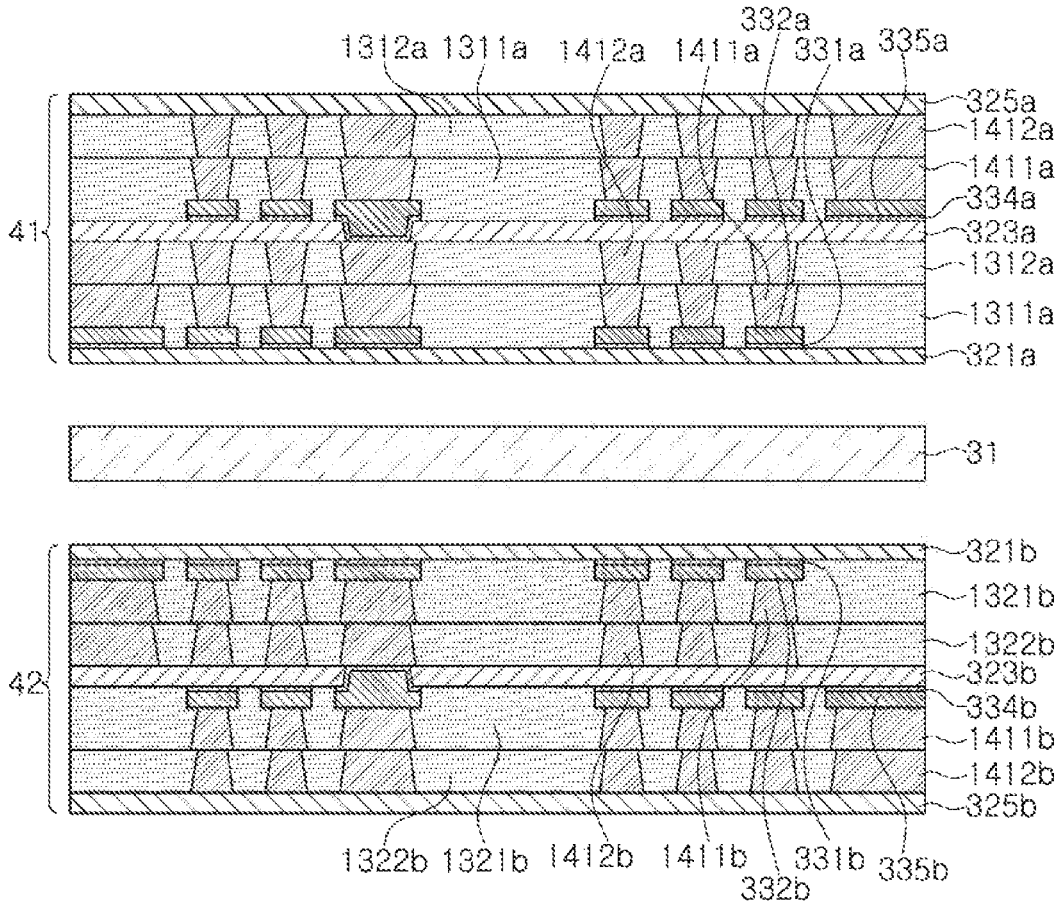
Figure 30:
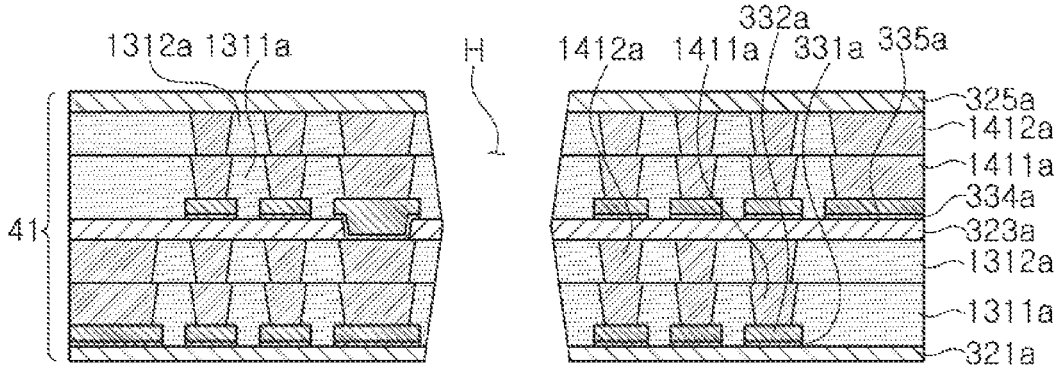
Figure 31:
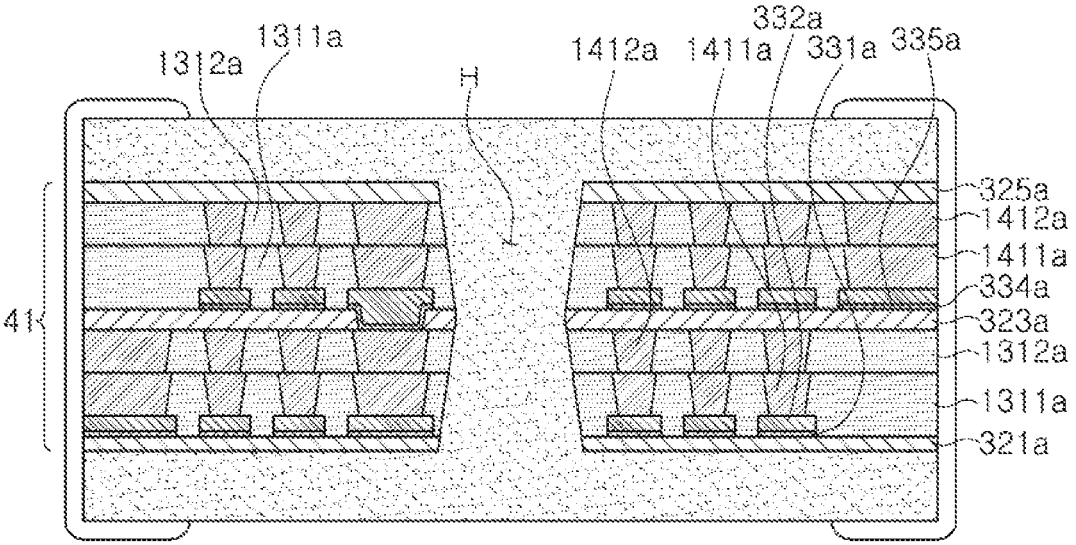

Next, referring to FIGS. 25 through 27, unlike FIGS. 3A through 3U, a second insulating portion 1312*a* that is the same as a second insulating portion 1311*a* may be additionally stacked (see FIG. 25), instead of laminating a third insulating film after second plating layers 1411*a* are formed. Then, the second insulating portion 1312*a* may be patterned using a laser beam to form openings penetrating through the second insulating portion (see FIG. 26), and second plating layers 1412*a* may be formed in the openings (see FIG. 27). Resultantly, the second plating layers 1412*a* may be directly stacked on the second plating layers 1411*a* that are the same as the second plating layers 1412*a*. In this case, the second plating layers (1411*a*+1412*a*) having an AR higher than that of the second plating layers 336*a* and 336*b* of FIGS. 3A through 3U may be derived, such that Rdc characteristics of the inductor may be significantly improved.

The respective processes illustrated in FIGS. 5 through 31 except for the processes described above overlap those illustrated in FIGS. 3A through 3U, and a detailed description therefor is thus omitted.

As set forth above, according to the exemplary embodiment in the present disclosure, an inductor having a low profile may be provided by reducing a thickness of a CCL core used as a support member in an existing thin film type inductor, and an inductor including coil patterns having a high aspect ratio may be provided through a simple process.

While exemplary embodiments have been shown and described above, it will be apparent to those skilled in the art that modifications and variations could be made without departing from the scope of the present disclosure as defined by the appended claims.

What is claimed is:

1. An inductor comprising:

a body including a first insulating film including a via electrode, a first insulating portion and a second insulating portion in contact with an upper surface and a lower surface of the first insulating film, respectively, second and third insulating films covering the first and second insulating portions, respectively, and an upper coil and a lower coil encapsulated by the first and second insulating portions, respectively; and first and second external electrodes disposed on external surfaces of the body, wherein the upper coil includes first via pads and first plating layers formed on the first via pads, the first via pads being disposed on the upper surface of the first insulating film, the lower coil includes second via pads and second plating layers formed on the second via pads, the second via pads being disposed on an upper surface of the third insulating film, both end portions of each of the first and second via pads include protrusion portions protruding with respect to lower surfaces of the first and second plating layers, and the upper surface and the lower surface of the first insulating film are boundary surfaces distinguished from the first and second insulating portions, respectively, wherein an area of a lower portion of the first and second plating layers contacting the first and second via pads respectively is smaller than an area of an upper surface of the corresponding first and second via pads.

2. The inductor of claim 1, wherein the first via pad includes a first metal thin film layer and a first metal pattern layer disposed on the first metal thin film layer, and the second via pad includes a second metal thin film layer and a second metal pattern layer disposed on the second metal thin film layer.

3. The inductor of claim 1, wherein at least some of the first via pads are directly connected to the via electrode.

4. The inductor of claim 1, wherein a cross section of each of the first and second plating layers has a reverse trapezoidal shape in which a lower surface thereof is smaller than an upper surface thereof.

5. The inductor of claim 1, wherein upper surfaces and side surfaces of the protrusion portions of the first and second via pads on which the first and second plating layers are not disposed in upper surfaces and side surfaces of the protrusion portions of the first and second via pads are surrounded by the first and second insulating portions, respectively.

6. The inductor of claim 1, wherein a material of the first insulating film includes one or more of Ajinomoto Build-up Film (ABF), polyimide, FR-4, and Bismaleimide Triazine (BT).

7. The inductor of claim 6, wherein the material of the first insulating film is the same as that of the first and second insulating portions.

8. The inductor of claim 1, wherein the material of the first insulating film is different from that of the first and second insulating portions.

9. The inductor of claim 1, wherein a material of each of the first and second insulating portions includes one or more of FR-4, BT, and polyimide.

10. The inductor of claim 1, wherein each of the first and second plating layers includes a plurality of plating pattern layers, and each of the first and second insulating portions includes a plurality of insulating pattern layers.

11. The inductor of claim 1, wherein a cross section of each of the first and second via pads has a rectangular shape.

12. The inductor of claim 1, wherein the body includes a magnetic material which encapsulates the second and third insulating films.

* * * * *